US005876898A

United States Patent [19]

Ikeda et al.

[11] Patent Number: 5,876,898

[45] Date of Patent: Mar. 2, 1999

[54] HEAT SENSITIVE RECORDING MATERIAL AND RECORDING METHOD USING THE SAME

[75] Inventors: Haruhiko Ikeda; Shigetoshi Hiraishi; Koji Suematsu, all of Tokyo, Japan

[73] Assignee: Mitsubishi Paper Mills Limited, Tokyo, Japan

[21] Appl. No.: 682,912

[22] Filed: Jul. 16, 1996

[30] Foreign Application Priority Data

| | | | |
|---|---|---|---|
| Jul. 18, 1995 | [JP] | Japan | 7-181227 |
| Oct. 12, 1995 | [JP] | Japan | 7-263745 |
| Feb. 22, 1996 | [JP] | Japan | 8-034657 |

[51] Int. Cl.[6] ..... G03C 8/00; B41M 5/36

[52] U.S. Cl. ..... 430/203; 430/336; 430/338; 503/200; 503/204; 503/208; 503/205

[58] Field of Search ..... 430/203, 955, 430/336, 338; 503/204, 208, 225, 200

[56] References Cited

U.S. PATENT DOCUMENTS

| | | | |
|---|---|---|---|
| 4,636,819 | 1/1987 | Nagamoto et al. | 346/216 |
| 4,665,410 | 5/1987 | Iiyama et al. | 346/204 |

FOREIGN PATENT DOCUMENTS

| | | |
|---|---|---|
| 0 012 587 | 6/1980 | European Pat. Off. . |
| 0 123 224 | 10/1984 | European Pat. Off. . |
| 2 142 447 | 1/1973 | France . |
| 7-304260 | 11/1995 | Japan . |
| 1 400 886 | 7/1975 | United Kingdom . |
| 2 150 702 | 7/1985 | United Kingdom . |

OTHER PUBLICATIONS

Takaoka, Kazucho, "Erasable thermal recording material containing vinyl polymer suspension", *Chemical Abstracts* 124(16), Abstract No. 216134 (Apr. 15, 1996).

European Search Report for EP Appln. No. 96111518.5, dated Jan. 7, 1997.

*Primary Examiner*—Thorl Chea

*Attorney, Agent, or Firm*—Pillsbury Madison & Sutro LLP

[57] ABSTRACT

A heat sensitive recording material is provided which can be simply prevented from falsification and is excellent in contrast between fixed portion and image portion, and a recording method using it is further provided. Moreover, there is provided a heat sensitive recording material capable of carrying out multicolor recording which is excellent in contrast of the image portions, density of the image portions, and image storage stability. That is, the present invention provides a heat sensitive recording material comprising a support and, provided thereon, one or a plurality of heat sensitive recording layers which contains at least one water-insoluble resin selected from the group consisting of an aromatic resin, a resin having a low or no acid value and a resin having a carbonyl group and an alicyclic unit, a heat sensitive recording material in which substantially no crystallized color developer is contained in a mixed melt obtained by mixing a given amount of the resin and a given amount the color developer, heating and melting the mixture and, then, leaving the melt to cool, and a recording method which carries out simultaneously the formation of an image portion by applying a low energy and the formation of a fixed portion by applying a high energy by a heating means on the above heat sensitive recording material by a thermal head.

17 Claims, No Drawings

HEAT SENSITIVE RECORDING MATERIAL AND RECORDING METHOD USING THE SAME

The present invention relates to a heat sensitive recording material which can be simply fixed and a recording method which can carry out a simple fixation. The present invention also relates to a heat sensitive recording material capable of multicolor recording which can give images excellent in contrast, density and image storage stability.

Heat sensitive recording materials usually comprise a support and, provided thereon, a heat sensitive recording layer mainly composed of an electron donating normally colorless or light colored dye precursor and an electron accepting color developer, and the dye precursor and the color developer instantaneously react with each other upon heating by a thermal head, a thermal pen, a laser beam or the like to form a recorded image. These are disclosed in JP-B 43-4160, 45-14039 and others.

These heat sensitive recording materials have merits in that the record can be obtained by a relatively simple device, maintenance is easy and less noise is generated, and they are utilized in a wide variety of the fields such as measuring recorder, facsimile, printer, terminal of computer, labels and automatic ticket machines.

However, since usual heat sensitive recording materials have the property of re-forming a color, there is a difficulty in prevention of falsification. However, the falsification here means that non-image portion of a heat sensitive recording material on which a color image (hereinafter referred to as merely "image portion") has once been formed is additionally printed by heating to re-form a color to obtain an image information different from that originally obtained. In usual heat sensitive recording materials, even after obtaining an image portion, the non-image portion is in such a state that it can always forms color upon printing by heating to form an image portion, and the originally obtained image portion cannot be discriminated from the image portion obtained by later printing with heating. Therefore, falsification is easy. Thus, for the prevention of falsification, a fixing method can be considered to provide a non-image portion in which no image portion can be formed by additional recording (this non-image portion is hereinafter referred to as "fixed portion").

As examples of providing the fixed portion, there are fixing type heat sensitive sheets disclosed in JP-A 59-190886, 5-208533, 5-142691, 5-142692 and 5-142693. The falsification can be prevented by these methods. However, these methods have many problems such as complication of recording equipments and requiring a long time for obtaining the image portion because the fixation is carried out by exposure.

Furthermore, JP-A 7-304260 proposes a heat sensitive recording material which can be recorded and fixed with heating by enclosing a leuco dye in particles of a vinyl polymer prepared by emulsion polymerization or suspension polymerization. However, a complex process is required for enclosing the leuco dye in the particles of vinyl polymer. In addition, only limited vinyl polymers and leuco dyes can be used in the above method.

As mentioned above, heat sensitive recording materials which can be simply fixed have not been able to be easily obtained, and simple fixing methods have not been able to be obtained.

On the other hand, multicolor recording is desired in many uses of heat sensitive recording materials. Under the circumstances, it is proposed to make a heat sensitive recording material which can carry out multicolor recording by providing a plurality of heat sensitive recording layers differing in the hue of the formed color. The simplest one comprises only two heat sensitive recording layers as disclosed in JP-A 58-183288 and 58-212987. An image portion of the first color is obtained by printing under lower temperature or energy and an image of the second color is obtained by printing under higher temperature or energy. In this case, however, the second color comprises a mixture with the hue of the first color and cannot be a vivid color. Besides, the contrast between the first and second colors is inferior. Therefore, the second color in multicolor recording by mixing the colors is mostly limited to black. Moreover, there is a defect that if the first color is, for example, red, the second black color becomes reddish in correspondence with the hue of the first color.

A proposal has been made to erase the image portion of the first color by a color eraser, thereby to obtain vividness of the second color and high contrast between the first color and the second color. For example, JP-A 62-174187, 62-174188, 62-279981 and 1-82986 disclose use of color erasers such as amides and piperidines. A typical layer construction in the case of using these color erasers comprises a support and, provided thereon in succession, a heat sensitive recording layer of the second color, a color eraser layer and a heat sensitive recording layer of the first color. Under the printing condition at which the heat sensitive recording layer of the second color forms a color, the heat sensitive recording layer of the first color does not form color or erases color by the action of the color eraser layer. However, when these erasers are used, the image density of the image portions, especially, the image portion of the first color conspicuously decreases or storage stability of the image is seriously deteriorated.

JP-A 4-35986 and 5-177929 propose multicolor recording using fixing type heat sensitive recording materials. However, these methods have many problems such as complication of recording equipments and requiring a long time for obtaining the image portion because the fixation is carried out by exposure. As explained above, no proposals have been made which are effective to obtain simply heat sensitive recording materials which can perform multicolor recording.

The object of the present invention is to provide a heat sensitive recording material which can be simply prevented from falsification and give excellent contrast between fixed portion and image portion and to provide a recording method according to which the fixation can be simply performed. The present invention further provides a heat sensitive recording material by which multicolor recording can be performed with excellent contrast between the image portions and excellent density and image storage stability.

According to the present invention, there is obtained a heat sensitive recording material comprising a support and, provided thereon, a heat sensitive recording layer containing a normally colorless or light colored dye precursor and an electron accepting color developer which reacts with the dye precursor upon heating to cause color formation of the dye precursor, wherein the heat sensitive recording material contains at least one water-insoluble resin selected from the group consisting of an aromatic resin, a resin having low or no acid value and a resin containing a carbonyl group and an alicyclic unit, whereby falsification can be simply prevented and the contrast between the fixed portion and the image portion is enhanced. The heat sensitive recording material is also excellent in density of the image portions and image storage stability.

Moreover, according to the present invention, multicolor recording can also be performed by using two or more normally colorless or light colored dye precursor which reacts with the electron accepting color developer upon heating to form different color hues. It is preferred for the contrast between the image portions to provide a plurality of heat sensitive recording layers differing in hue of formed color. The heat sensitive recording material is excellent in contrast of the image portions, density of image portions and image storage stability.

Furthermore, a simple fixing method is provided by simultaneously or separately carrying out the formation of an image portion by applying a low energy and the formation of a fixed portion by applying a high energy by using a heating means on the heat sensitive recording material of the present invention which can be recorded and fixed by heating.

Next, resins usable preferably for the heat sensitive recording materials of the present invention will be explained and examples of the resins will be enumerated below. A preferred contrast between the image portion and the fixed portion is obtained by using these resins. In the case of multicolor recording, the contrast between the hues of the formed colors is superior. These resins may be used each alone or in combination of two or more. The resins used in the present invention are not limited to those exemplified below.

As the aromatic resins used in the present invention, there may be preferably used epoxy resin, xylene resin, polyester resin, terpene phenol resin, rosin-modified phenolic resin, phenoxy resin, styrene resin (polystyrene), polyethylene terephthalate (polyethylene terephthalate resin), carboxy-modified polyethylene terephthalate (carboxy-modified polyethylene terephthalate resin), polybutylene terephthalate (polybutylene terephthalate resin), allyl resin, methyl methacrylate-styrene copolymer (methyl methacrylate-styrene resin), methyl methacrylate-butadiene-styrene copolymer (methyl methacrylate-butadiene-styrene resin), oxybenzoylpolyester resin, aromatic petroleum resin, styrene-acrylonitrile copolymer (styrene-acrylonitrile resin), polyphenylene oxide resin, polyphenylene sulfide resin, polyether ether ketone resin, polyether sulfone (polyallyl sulfone) resin, and the like. These are advantageous from the point of availability.

As the resins having a low acid value or no acid value used preferably in the present invention, mention may be made of, for example, maleic acid resin, long chain olefin glycol (long chain olefin glycol resin), polymethyl methacrylate (polymethyl methacrylate resin), acrylic ester resin, hydroxyl group-containing dicyclopentadiene alicyclic hydrocarbon resin, furan resin, bismaleimide-triazine resin, polycarbonate (polycarbonate resin), polyarylate (polyarylate resin), polyacetal (polyacetal resin), unsaturated polyester resin, cumarone resin, polyimide resin, rosin-modified polyimide resin, poly(amide-imide) resin, polyurethane (polyurethane resin), polyvinylacetal (polyvinylacetal resin), ketone resin such as cyclohexanone ketone resin, and the like. These are superior from the point of general-purpose properties. The acid value of the low acid value resins is lower the better and is preferably 250 mg KOH/g or less, especially preferably 200 mg KOH/g or less.

Examples of the carbonyl group contained in the resin having a carbonyl group and an alicyclic unit are ester group, carbonic ester group (carbonic ester group is also one of ester groups), amide group, urethane group, urea group, ketone group, aldehyde group, and the like. Of these groups, the ester group is easy in introduction from the points of general purpose properties of resin raw material and easiness in production of resin. Therefore, among the resins having carbonyl group and alicyclic unit, those having an ester group and an alicyclic group are preferred from the points of general purpose properties of resin raw materials and easiness in production of resins.

In the case of the carbonyl group being an ester group, when the saponification value of the resin is 50–700 mg KOH/g, density of the fixed portion is low and this is more preferred. The preferred condition of the saponification value mentioned here can be applied to other resins having an ester group.

As the resins having an ester group and an alicyclic unit, copolymer of dicyclopentadiene and vinyl acetate, copolymer of cyclopentene and vinyl acetate, copolymer of cyclohexene and vinyl acetate, copolymer of dicyclopentadiene and methyl acrylate, copolymer of dicyclopentadiene and ethyl acrylate, copolymer of dicyclopentadiene and methyl methacrylate, copolymer of dicyclopentadiene and ethylene carbonate, and the like, are preferred in points of general-purpose properties of resin raw materials and easiness in preparation of the resins. As other resins having carbonyl group and alicyclic unit, rosin-modified phenolic resin, rosin-modified maleic acid resin, copolymer of dicyclopentadiene and acrolein, copolymer of dicyclopentadiene and acrylamide, copolymer of dicyclopentadiene and divinylurea, copolymer of dicyclopentadiene and vinyl carbamate, and the like, are preferred from the point of general-purpose properties of raw materials for resins. These may also be used each alone or in combination of two or more.

The typical processes for producing the resin having a carbonyl group and an alicyclic unit can be classified into the following three.

1. A process which comprises copolymerizing a raw material having a carbonyl group and a raw material having an alicyclic unit.

2. A process which comprises polymerizing a raw material having a carbonyl group and an alicyclic unit together (amphoteric raw material).

3. A process which comprises treating various raw material resins to make a resin having a carbonyl group and an alicyclic unit.

Examples of the raw material having a carbonyl group and the raw material having an alicyclic unit in the case of obtaining the resin by the above process 1 are mentioned below. The resin is obtained by copolymerizing one or optional combination of two or more of the respective raw materials. The resulting resin may be subjected to necessary after-treatments such as hydrogenation.

As examples of the raw materials having a carbonyl group, mention may be made of vinyl acetate, dimethyl maleate, methyl acrylate, ethyl acrylate, butyl acrylate, benzyl acrylate, phenyl acrylate, methyl methacrylate, ethyl methacrylate, butyl methacrylate, benzyl methacrylate, phenyl methacrylate, methyl crotonate, acrolein, acrylamide, methacrylamide, ethylene carbonate, divinylurea, vinyl carbamate, and the like.

As examples of the raw materials having an alicyclic unit, mention may be made of cyclopentene, cyclohexene, 2-norbornene, 2,5-norbornanediene, cyclopentadiene, dicyclopentadiene, 1,3-cyclohexadiene, 1,4-cyclohexadiene, cycloheptene, cyclododecene, vinylcyclohexane, tetrahydronaphthalenes, decahydrobiphenyls, α-terpineol, verbenol, α-pinene, β-pinene, 3-carene, camphene, α-terpinene, 1-methyl-4-(1-methyl-vinyl)cyclohexene, terpinolene, alloocimene, and the like. Among them, dicyclopentadiene is superior in points of general-purpose properties and easiness in preparation of the resins.

As examples of the amphoteric materials in case of obtaining the resin by polymerization of the amphoteric raw material in accordance with the above process 2, mention may be made of methyl cyclohexene-1-carboxylate, methyl cyclohexene-3-carboxylate, methyl cyclohexene-4-carboxylate, cyclohexyl acrylate, cyclohexyl methacrylate, dicyclohexyl maleate, dicyclohexyl fumarate, vinyl cyclohexylcarboxylate, 1-acetyloxycyclohexene, 3-acetyloxycyclohexene, 4-acetyloxycyclohexene, abietic esters, maleinimide, N-methylmaleinimide, and the like. These may be used each alone or in combination of two or more. The resin may be obtained using the amphoteric raw material in combination with the raw material having an alicyclic unit or the raw material having an ester group exemplified in the above process 1.

When resins are obtained by copolymerization or polymerization in accordance with the above process 1 or 2, one or more of monomers of general-purpose polymers can be used in combination with the respective raw materials mentioned in the explanation of the process 1 or 2. Examples of the monomers usable in combination are styrene, α-methylstyrene, ethylene, propylene, 1,3-butadiene, 2-methyl-1,3-butadiene, 2-chloro-1,3-butadiene, vinyl chloride, vinylidene chloride, acrylonitrile, maleic anhydride, divinylbenzene, methylvinyl ether, ethylvinyl ether, furan, thiophene, indene, benzofuran, cumarone, and the like.

In the above process 3, namely, the process for obtaining the resin having a carbonyl group and an alicyclic unit by treating various raw material resins, the raw material resin or the resulting resin is not necessarily a polymer having recurring units and may be a water-insoluble solid. The "water-insoluble" here means that the solubility of the resin in water at room temperature (20° C.) is 1% by weight or lower. The treating method of various raw material resins includes, for example, esterification of carboxyl group or hydroxyl group in the raw material resins and hydrogenation of the aromatic ring of the raw material resins. These methods will be explained below.

The esterification of the raw material resins can be easily carried out by known method. The raw material resins include, for example, abietic acid (resin acid) or isomers thereof and the like. Even if the unsaturated bond of the abietic acid is partially hydrogenated, dehydrogenated, oxidized or migration, it can be used as a raw material resin. Vegetable resins such as natural rosins mainly composed of abietic acid or isomers thereof or the like can also be used as the raw material resins. Examples of the ester group contained in the resulting resins are methyl ester group, ethyl ester group, butyl ester group, octyl ester group, octadecyl ester group, glyceryl ester group, ester group with pentaerythritol, vinyl ester group, and the like.

The hydrogenation of the raw material resins can also be carried out by known methods. As examples of the raw material resins, mention may be made of aromatic polyesters such as polyethylene terephthalate, polybutylene terephthalate, polynaphthylene terephthalate, aromatic polycarbonate, and the like.

As the aromatic resins used in the present invention, epoxy resins, especially, those having a glycidyl group and an aromatic ring unit are preferred for the contrast between the image portion and the fixed portion. Hereinafter the resins having a glycidyl group and an aromatic ring unit are called specific epoxy resins.

As the aromatic ring unit of the specific epoxy resins, mention may be made of, for example, phenol skeleton, α-naphthol skeleton, β-naphthol skeleton, o-cresol skeleton, m-cresol skeleton, p-cresol skeleton and bisphenol A skeleton. These are preferred for the general-purpose properties of the resin raw materials. These aromatic ring units may be bonded through a methylene group in addition to a linkage produced by the reaction of glycidyl group with phenolic hydroxyl group. Furthermore, a part or all of the aromatic ring hydrogen atoms of the aromatic ring units may be substituted with chlorine atom or bromine atom.

The epoxy equivalent of the specific epoxy resins is preferably 150–3000 g/l mol epoxy group for image storage stability and contrast between the fixed portion and the image portion. The epoxy equivalent here is a resin weight per 1 mol of epoxy group. The 1 mol epoxy group in this case means epoxy group of Avogadro number.

The resins usable preferably in the present invention can also be explained on the basis of the relation between the color developer and the resin and on the basis of softening point of the resin.

The resin has a softening point of 70° C. or higher and the relation between the color developer and the resin is such that substantially no crystallized color developer is contained in a mixed melt formed by mixing 100 parts by weight of the resin with 50–200 parts by weight of the color developer, heating the mixture to melt it, and then leaving the melt to cool.

That substantially no crystallized color developer is contained in a mixed melt means that compatibility between the color developer and the resin at room temperature is good. However, it is difficult to expect that if the compatibility is good, the contrast between the image portion and the fixed portion of the heat sensitive recording material of the present invention becomes superior.

For determination of whether crystallized color developer is present or not in the mixed melt, the color developer and the resin are mixed, heated, molten and cooled by leaving as it is, thereby to obtain a mixed melt. If the compatibility between the color developer and the resin is inferior, crystallization of the color developer is found in the mixed melt in which the proportion of the color developer to the resin is lower. In the present invention, crystallinity of the color developer is obtained in the mixed melt comprising 50 parts by weight or more, more preferably 100 parts by weight or more, further preferably 200 parts by weight or more of the color developer for 100 parts by weight of the resin. The crystallinity of the color developer can be easily measured by an analysis means such as X-ray diffraction. By comparing the result of measurement with the result of measurement such as X-ray diffraction or the like of a mere mixture of crystalline color developer and resin, the crystallinity of the color developer in the mixed melt can be obtained. When the crystallinity is lower than 5%, it is defined in the present invention that substantially no crystallized color developer is contained. The resin which contains substantially no crystallized color developer in the mixed melt is used preferably in the present invention. When this condition is satisfied, compatibility between the color developer and the resin is good and heat sensitive recording materials superior in the contrast between the image portion and the fixed portion are obtained. Even when crystallized color developer was not contained in a mixed melt containing less than 50%, for example, 25% of the color developer based on the resin, no correlation with characteristics such as contrast was found.

The softening point of the resin is preferably 70° C. or higher, more preferably 90° C. or higher for improvement of density of the image portion and image storage stability. If the softening point is lower than 70° C., decrease in density of the image portion and deterioration of image storage stability are seen. The softening point has no special upper limit. In many cases, the softening point can be easily and definitely measured by known methods. However, when the melting point (liquefying temperature) of the resin can be measured by known method, the melting point is employed as the softening point of the resin. In other cases, the softening point is measured, for example, by globule method.

The resin may be either a high molecular compound or a low molecular compound. However, molecular weight or number-average molecular weight of the resin is preferably at least 200, more preferably at least 400 for improvement of density of the image portion and image storage stability. If the molecular weight or number-average molecular weight of the resin is lower than 200, flowability or volatility of the resin at heating increases, which may have an adverse effect on the density of the image portion or image storage stability.

In order to improve the compatibility between the color developer and the resin, the resin preferably has a functional group containing a non-shared electron pair.

As preferred examples of the functional groups having a non-shared electron pair, mention may be made of ether group, ester group, carbonic ester group, ketone group, aldehyde group, acetal group, ketal group, hydroxy group, cyano group, amide group, urea group, urethane group, azo group, hydrazide group, sulfide group, thio group, sulfoxide group, S-thioester group, O-thioester group, dithioester group, and thioketone group. These groups may form a ring. A plurality of the same functional groups may be contained in the resin or two or more of different functional groups may be contained in the resin.

The resin used in the present invention is preferably water-insoluble from the points of image density and image storage stability. The "water-insoluble" here means that the solubility in water at room temperature (20° C.) is 1% by weight or lower. For the image storage stability, the solubility in water at room temperature (20° C.) is more preferably 0.1% by weight or lower.

Use of the resin in an amount of preferably 50% by weight or more, more preferably 200% by weight or more, especially 400% by weight or more based on the color developer is preferred from the point of contrast between the fixed portion and the image portion.

The resin used for the heat sensitive recording materials of the present invention which is water-insoluble or has a softening point of 70° C. or higher may be used in any of the support and the layers constituting the heat sensitive recording material, but when it is contained in the support or layers other than the heat sensitive recording layer, a high image density can be obtained and this is preferred. Specifically, a resin layer containing the resin is provided contiguous to the heat sensitive recording layer, or the resin is contained in the support, or the support per se comprises the resin. Another interlayer may be provided between the resin layer and the heat sensitive recording layer or between the resin layer and the support.

The heat sensitive recording material of the present invention is generally obtained by coating on a support or another layer a heat sensitive recording layer mainly composed of a dye precursor and a color developer which are dispersed therein. The heat sensitive recording layer may further contain a binder, a sensitizer, a pigment and other additives. The resin of the present invention may be contained in the heat sensitive recording layer. Furthermore, if necessary, various layers may be provided in addition to the heat sensitive recording layer. The materials used and the construction of layers will be explained in detail below.

First, coating amount of the heat sensitive recording layer, and the dye precursor and the color developer contained in the heat sensitive recording layer as color forming components according to the present invention will be explained below.

The coating amount of the heat sensitive recording layer is determined depending on the amounts of the dye precursor and the color developer, and usually a coating amount of the dye precursor of 0.15–2.0 g/m$^2$ is preferred for obtaining image density and color forming sensitivity. Further, a coating amount of the dye precursor of 0.20–1.5 g/m$^2$ is more preferred for obtaining an excellent contrast between the fixed portion and the image portion.

The proportion of the color developer to the dye precursor is preferably 10–2000% by weight for obtaining color forming sensitivity and excellent contrast between the fixed portion and the image portion.

As the dye precursor, a normally colorless or light colored electron donating compound can preferably be used. Examples of the dye precursor are enumerated below. These dye precursors can be used each alone or in combination of two or more.

(1) Triarylmethane compounds and indolyl phthalide compounds:

3,3-Bis(p-dimethylaminophenyl)-6-dimethylaminophthalide (crystal violet lactone), 3,3-bis(p-dimethylaminophenyl)phthalide, 3-(p-dimethylaminophenyl)-3-(1,2-dimethylindol-3-yl)phthalide, 3-(p-diethylaminophenyl)-3-(2-methylindol-3-yl)phthalide, 3-(p-dimethylaminophenyl)-3-(2-methylindol-3-yl)phthalide, 3-(2-methyl-4-dimethylaminophenyl)-3-(2-methylindol-3-yl)phthalide, 3-(p-dimethylaminophenyl)-3-(2-phenyl-indol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrrol-2-yl)-6-dimethylaminophthalide, 3-(1-ethyl-2-methylindol-3-yl)-3-(4-dimethylamino-2-ethoxyphenyl)-4-azaphthalide, 3-(1-ethyl-2-methylindol-3-yl)-3-(4-dimethylamino-2-ethoxyphenyl)-7-azaphthalide, 3-(1-ethyl-2-methylindol-3-yl)-3-(4-dimethylamino-2-ethoxyphenyl)-4,7-diazaphthalide, 3,3-bis(4-diethylamino-2-ethoxyphenyl)-4-azaphthalide, 3-(4-diethylamino-2-ethoxyphenyl)-3-(4-N-phenyl-N-ethylamino-2-ethoxyphenyl)-4-azaphthalide, and the like.

(2) Diphenylmethane compounds:

4,4'-Bis(dimethylaminophenyl)benzhydrylbenzyl ether, N-chlorophenylleucoauramine, N-2,4,5-trichlorophenylleucoauramine, and the like.

(3) 2-Anilinofluoran (or 7-anilinofluoran) compounds:

3-Diethylamino-6-methyl-7-anilinofluoran, 3-piperidino-6-methyl-7-anilinofluoran, 3-pyrrolidino-6-methyl-7-anilinofluoran, 3-diethylamino-6-methyl-7-(4-methylanilino)fluoran, 3-diethylamino-6-methyl-7-(4-n-butylanilino)fluoran, 3-diethylamino-6-methyl-7-(4-ethoxyanilino)fluoran, 3-pyrrolidino-6-methyl-7-(4-methylanilino)fluoran, 3-pyrrolidino-6-methyl-7-(4-n-butylanilino)fluoran, 3-pyrrolidino-6-methyl-7-(4-ethoxyanilino)fluoran, 3-di-n-propylamino-6-methyl-7-anilinofluoran, 3-di-n-butylamino-6-methyl-7-anilinofluoran, 3-di-n-pentylamino-6-methyl-7-anilinofluoran, 3-(N-methyl-N-n-propyl)amino-6-methyl-7-anilinofluoran, 3-(N-ethyl-N-n-propyl)amino-6-methyl-7-anilinofluoran, 3-(N-ethyl-N-isoamyl)amino-6-methyl-7-anilinofluoran, 3-(N-ethyl-N-isobutyl)amino-6-methyl-7-anilinofluoran, 3-(N-methyl-N-cyclohexyl)amino-6-methyl-7-anilinofluoran, 3-(N-methyl-N-tetrahydrofuran-2-ylmethyl)amino-6-methyl-7-anilinofluoran, 3-(N-ethyl-N-tetrahydrofuryl-methyl)amino-6-methyl-7-anilinofluoran, 3-(N-methyl-N-tetrahydrofuran-2-yl)amino-6-methyl-7-anilinofluoran, 3-(N-ethyl-N-tetrahydrofuryl)amino-6-methyl-7-anilinofluoran, 3-dimethylamino-6-methyl-7-anilinofluoran, 3-(N-methyl-N-ethyl)amino-6-methyl-7-anilinofluoran, 3-isopentylamino-6-methyl-7-anilinofluoran, 3-di-n-butylamino-6-methyl-7-(2-fluoroanilino)fluoran, 3-dibutylamino-6-methoxy-7-anilinofluoran, 3-di-n-butylamino-6-methyl-7-(2,6-dimethylanilino)fluoran, 3-(N-ethyl-N-3-ethoxypropyl) amino-6-methyl-7-anilinofluoran, 3-(N-methyl-N-3-ethoxypropyl)amino-6-methyl-7-anilinofluoran, 3-diethylamino-6-methyl-7-(3-trifluoromethylanilino) fluoran, 3-diethylamino-7-(3-trifluoromethylanlino)fluoran, 3-diethylamino-7-(2-chloroanilino)fluoran, 3-diethylamino-7-(3-chloroanilino)fluoran, 3-di-n-butylamino-7-(3-chloroanilino)fluoran, 3-diethylamino-7-(2-fluoroanilino) fluoran, 3-diethylamino-7-(2-methoxyanilino)fluoran, 3-pyrrolidino-7-(2-chloroanilino)fluoran, 3-pyrrolidino-7-(3-chloroanilino)fluoran, 3-pyrrolidino-7-(2-methoxyanilino)-fluoran, 3-diethylamino-7-(2-isopentyloxycarbonylanilino)fluoran, 3-(N-ethyl-N-p-tolyl) amino-6-methyl-7-anilinofluoran, and the like.

(4) Other fluoran compounds and xanthene compounds:

3-Pyrrolidino-7-cyclohexylaminofluoran, 3-diethylamino-7-dibenzylaminofluoran, 3-diethylamino-7-n-octylaminofluoran, 3-diethylamino-7-phenylfluoran, 3-diethylamino-7-chlorofluoran, 3-diethylamino-6-chloro-7-methylfluoran, 3-diethylamino-6-methyl-7-chlorofluoran, 3-di-n-butylamino-6-methyl-7-chlorofluoran, 3-diethylamino-7-(3,4-dichloroanilino)fluoran, 3-ethylamino-6-chlorofluoran, 3-cyclohexylamino-6-chlorofluoran, 3-diethylamino-7-dibenzylaminofluoran, 3-di-n-butylamino-7-(2-chlorobenzylamino)fluoran, Rhodamine B anilinolactam, Rhodamine B-p-chloroanilinolactam, and the like.

(5) Spiro compounds:

Spiropyran compounds such as 3-methylspirodinaphthopyran, 3-ethylspirodinaphthopyran, 3,3'-dichlorospirodinaphthopyran, 3-benzylspirodinaphthopyran, 3-methylnaphtho-(3-methoxybenzo)spiropyran, and 3-propylspirobenzopyran; compounds having a fluorene skeleton such as 3',6'-bisethylamino-5-diethylaminospiro(isobenzofuran-1,9'-fluoren)-3-one and 3',6'-bismethylamino-5-dimethylaminospiro(isobenzofuran-1,9'-fluoren)-3-one; vinylogous triarylmethane compounds such as 3,3-bis-[2-(4-methoxyphenyl)-2-(4-dimethylaminophenyl)ethenyl]-4,5,6,7-tetrachlorophthalide; and the like.

As the color developers, electron accepting compounds are used, and phenol derivatives represented by the following formula (1) are especially preferred for obtaining excellent contrast between the fixed portion and the image portion.

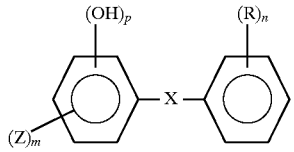

(1)

(wherein R represents a hydroxyl group, an alkoxy, aralkyloxy or aryloxy group of 1–24 carbon atoms, an allyl group, an alkyl, aralky or aryl group of 1–24 carbon atoms, an alkoxycarbonyl, an aralkyloxycarbonyl or aryloxycarbonyl group of 1–25 carbon atoms, an acyloxy or aroyloxy group of 1–25 carbon atoms, an acyl or aroyl group of 1–24 carbon atoms, or a halogen atom; x represents an alkylene, cycloalkylene, aralkylene or arylene group of 1–12 carbon atoms or a divalent group including a sulfide group, a disulfide group, a sulfone group, a carbonyl group or an ester group; Z represents a methyl group, an allyl group, a t-butyl group, a hydroxyl group, a chlorine atom or a bromine atom; p represents 1, 2 or 3; m represents 0, 1 or 2; and n represents 0, 1, 2 or 3).

As examples of X in the formula (1) which is a divalent group containing an ester group, mention may be made of —COO—, —$COOCH_2$—, —OCOO—, —CH($COOCH_3$)— and —CH($COOCH_2CH_2CH_2CH_3$)—.

As examples of the phenol derivatives represented by the formula (1), mention may be made of 1,1-bis(4-hydroxyphenyl)propane, 1,1-bis(4-hydroxyphenyl)pentane, 1,1-bis(4-hydroxyphenyl)hexane, 1,1-bis(4-hydroxyphenyl) cyclohexane, 1,1-bis(4-hydroxyphenyl)-2-ethylhexane, 2,2-bis(4-hydroxyphenyl)propane (also called bisphenol A), 2-(3,4-dihydroxyphenyl)-2-phenylpropane, 2-(3-hydroxyphenyl)-2-(4-hydroxyphenyl)-propane, 1,2-bis(4-hydroxyphenyl)ethane, 2,2-bis(4-hydroxyphenyl)hexane, 2,2-bis(4-hydroxyphenyl)octane, 1,1-bis(4-hydroxyphenyl)-2-ethylhexane, 2,2-bis(3-chloro-4-hydroxyphenyl)propane, 2,2-bis(3-bromo-4-hydroxyphenyl)propane, 1,1-bis(4-hydroxyphenyl)-1-phenylethane, 1,3-di-[2-(4-hydroxyphenyl)-2-propyl]benzene, 1,3-di-[2-(3,4-dihydroxyphenyl)-2-propyl]benzene, 1,4-di-[2-(4-hydroxyphenyl)-2-propyl]benzene, 4,4'-dihydroxydiphenyl ether, 3,3'-dichloro-4,4'-dihydroxydiphenyl sulfide, methyl 2,2-bis(4-hydroxy-phenyl)acetate, ethyl 2,2-bis(4-hydroxyphenyl)acetate, butyl 2,2-bis(4-hydroxyphenyl) acetate, 4,4 '-thiobis(2-t-butyl-5-methylphenol), benzyl p-hydroxybenzoate, p-hydroxybenzophenone, p-chlorobenzyl p-hydroxybenzoate, 4-hydroxy-4'-methyldiphenylsulfone, 4-hydroxy-4'-isopropoxydiphenylsulfone, 4-hydroxy-4'-benzenesulfonyloxydiphenylsulfone, 4,4'-dihydroxydiphenylsulfone, 2,4'-dihydroxydiphenylsulfone, 3,4-dihydroxydiphenylsulfone, 3,3'-dichloro-4,4'-dihydroxydiphenylsulfone, 3,3'-diallyl-4,4'-dihydroxydiphenylsulfone, benzyl gallate, stearyl gallate, and the like. These may be used each alone or in combination of two or more.

In addition to the above color developers, there may also be used those which are generally used for heat sensitive recording materials. Examples are salicylanilide, 5-chlorosalicylanilide, dimethyl 4-hydroxyphthalate, p-phenylphenol, octadecyl 4-hydroxybenzoate, zinc salicylate, 3,5-di-t-butylsalicylic acid or zinc salt thereof, 4-hexadecanoylaminosalicylic acid or zinc salt thereof, 4-dodecanoylaminosalicylic acid or zinc salt thereof, 4-decanoylaminosalicylic acid or zinc salt thereof, 3,5-di-α-phenethylsalicylic acid or zinc salt thereof, aluminum chloride, and acid clay.

Next, components of the heat sensitive recording layer according to the present invention will be explained.

As the binders used in the heat sensitive recording layer, mention may be made of, for example, water-soluble polymers such as starches, hydroxyethylcellulose, methylcellulose, carboxymethylcellulose, gelatin, casein, polyvinyl alcohol, modified polyvinyl alcohol, alkali salt or ammonium salt of polyacrylic acid, acrylamide/acrylate copolymer, acrylamide/acrylate/methacrylic acid terpolymer, alkali salt or ammonium salt of styrene/maleic anhydride copolymer, and alkali salt or ammonium salt of ethylene/maleic anhydride copolymer, latexes such as ammonium alginate, polyvinyl acetate, polyurethane, polyacrylate, styrene/butadiene copolymer, acrylonitrile/butadiene copolymer, methyl acrylate/butadiene copolymer and ethylene/vinyl acetate copolymer, and the like.

Furthermore, a sensitizer may be added for improving the color forming sensitivity. As the sensitizer, there may be used waxes such as N-hydroxymethylstearic acid amide, N-hydroxymethylbehenic acid amide, palmitic acid amide, stearic acid amide, behenic acid amide and 1,2-bisoctadecanoylaminoethane; urea derivatives such as octadecylurea; naphthol derivatives such as 2-benzyloxynaphthalene and 1-benzyloxy-4-methoxynaphthalene; biphenyl derivatives such as p-benzylbiphenyl, 4-allyloxybiphenyl, m-terphenyl and 4-(4-methylphenoxy)biphenyl; polyether compounds such as 1,2-bis(3-methylphenoxy)ethane, 1,2-diphenoxyethane, 2,2'-bis(4-methoxyphenoxy)diethyl ether, and bis(4-methoxyphenyl) ether; carbonic acid or oxalic acid diester derivatives such as diphenyl carbonate, dibenzyl oxalate and bis(p-methylbenzyl) oxalate; and the like. These may be used each alone or in combination. The preferred amount of the sensitizer used is 10–400% by weight of the color developer.

As pigments, mention may be made of inorganic pigments such as diatomaceous earth, talc, kaolin, calcined kaolin, calcium carbonate, calcium silicate, magnesium carbonate, basic magnesium carbonate, barium sulfate, titanium oxide, zinc oxide, silicon dioxide, silicic acid, aluminum hydroxide and alumina and organic pigments such as urea-formaldehyde resin, polystyrene resin and starch.

The heat sensitive recording layer may further contain metal salts of higher fatty acids such as zinc stearate, calcium stearate and barium stearate; waxes such as paraffin, paraffin oxide, polyethylene, polyethylene oxide, stearic acid amide, ethylenebisstearic acid amide and castor wax; dispersants such as sodium dioctylsulfosuccinate and sulfonic acid-modified polyvinyl alcohol; organic ultraviolet absorbers such as benzophenone type and benzotriazole type; inorganic ultraviolet absorbers such as zinc oxide, titanium dioxide and cerium oxide; surface active agents; fluorescent brighteners; and the like. Furthermore, antioxidants and light stabilizers such as hindered phenols and hindered amines may be contained for improving image storage stability. Moreover, when recording is carried out with infrared rays or laser beams, known infrared absorbers such as phthalocyanine derivatives and nickel complexes may be contained.

As the supports for heat sensitive recording materials of the present invention, depending on the purposes, there may be optionally used paper, various nonwoven fabrics, woven fabrics, plastic films such as polyethylene terephthalate and polypropylene, film-laminated papers comprising a paper laminated with synthetic resins such as polyethylene, polypropylene and polyethylene terephthalate, synthetic papers, metallic foils such as aluminum, and glasses, and composite sheets comprising combination of them. These are not limiting. In the present invention, synthetic papers prepared using the same materials as used for plastic films are included in the scope of the plastic films. The support per se or the film to be laminated may be the resin used in the present invention. These may be opaque, translucent or transparent. In order for the background appearing to have white or other specific colors, a white pigment, a colored dye or pigment, air bubbles or the resin of the present invention may be contained in the support or provided on the surface of the support. When the hydrophilicity of the surface of the support is small and it is difficult to coat the surface with an aqueous coating liquid, the surface of the support may be subjected to a treatment for easy adhesion such as rendering hydrophilic by corona discharge or the like, surface roughening or coating of various polymers. Further necessary treatments may be conducted for anti-curling or antistatic purpose or improvement of running properties.

Pigments may be optionally used in the resin layer or interlayer. Examples of the pigments are inorganic pigments such as diatomaceous earth, talc, kaolin, calcined kaolin, calcium carbonate, magnesium carbonate, basic magnesium carbonate, titanium oxide, zinc oxide, silicon dioxide, silicic acid, alumina, aluminum hydroxide, calcium silicate, barium sulfate and precipitated barium sulfate and organic pigments such as urea-formaldehyde resin, polystyrene resin, polyethylene resin, polypropylene resin, benzoguanamine resin and various grain starches. These may be used each alone or in combination of two or more. These pigments may also be contained in the heat sensitive recording layer.

In the resin layer or interlayer, there may be optionally used water-soluble polymers or latexes as binders. Examples of the binders are water-soluble polymers such as starches, hydroxyethylcellulose, methylcellulose, carboxymethylcellulose, gelatin, casein, polyvinyl alcohol, modified polyvinyl alcohol, sodium polyacrylate, acrylamide/acrylate copolymer, acrylamide/acrylate/methacrylic acid terpolymer, alkali salt of styrene/maleic anhydride copolymer, alkali salt or ammonium salt of ethylene/maleic anhydride copolymer and ammonium alginate, and latexes such as polyvinyl acetate, polyurethane, polyacrylate, styrene/butadiene copolymer, acrylonitrile/butadiene copolymer, methyl acrylate/butadiene copolymer, ethylene/vinyl acetate copolymer, ethylene/vinyl chloride copolymer, polyvinyl chloride, ethylene/vinylidene chloride copolymer and polyvinylidene chloride. These water-soluble polymers and latexes can also be used in the heat sensitive recording layer. The water-soluble polymers and latexes used in the resin layer, interlayer and heat sensitive recording layer may be the same or different.

When the water-soluble polymers, latexes or mixtures thereof are used in the resin layer or interlayer, the amount thereof is preferably at least 5% by weight, especially at least 10% by weight of the solid matter (the solid matter being the total of the heat meltable components such as pigment, resin and others) from the viewpoint of bond strength.

Furthermore, if necessary, the resin layer or interlayer may contain various additives which are referred to in the above explanation on the heat sensitive recording layer. Especially, addition of organic ultraviolet absorbers such as benzophenone type and benzotriazole type or inorganic ultraviolet absorbers such as zinc oxide, titanium dioxide and cerium oxide is preferred from the points of light resistance of background, image portion and fixed portion.

A protective layer may be provided in the heat sensitive recording material of the present invention. As the materials of the protective layer, mention may be made of film-forming materials such as the water-soluble polymers or latexes illustrated in the above explanation on the binder or the resin layer or interlayer of the heat sensitive recording layer. In this case, a hardener or a crosslinking agent such as a compound having epoxy group, a zirconium salt or glyoxal can also be contained. Examples thereof are zirconium ammonium carbonate, polyamidoepichlorohydrin and glyoxal. In addition, the protective layer can be formed by coating a photo-curing or electron radiation curing resin or a heat curing resin and curing the coat. The protective layer may contain the resin of the present invention. Moreover, a plastic film may be laminated to form a protective layer. For example, various plastic films illustrated in the explanation of the support may be used for lamination. In any of the above cases, pigments and the like may be contained in the protective layer for further improvement of writing and running properties. Average particle size of the pigment used in the protective layer is preferably 2 microns or less, more preferably 0.4 micron or less from the point of image density. The protective layer may comprise a plurality of layers, namely, two layers or three or more layers.

The pigment used optionally in the protective layer may have the same composition as of the pigment used in the heat sensitive recording layer. Furthermore, if necessary, various additives which are referred to in the above explanation of the heat sensitive recording layer may be used in the protective layer. Especially, addition of organic ultraviolet absorbers such as benzophenone type and benzotriazole type or inorganic ultraviolet absorbers such as zinc oxide, titanium dioxide and cerium oxide is preferred from the points of light resistance of texture, image portion and fixed portion.

Furthermore, materials in which information can be electrically, optically or magnetically recorded may be contained in the heat sensitive recording layer and other layers and the support or in the layers provided on the side of the support opposite to the side on which the heat sensitive recording layer is provided. Moreover, a back coat layer may be provided on the side of the support opposite to the side on which the heat sensitive recording layer is provided for prevention of blocking and curling, for giving antistatic properties or for improvement of running properties. Furthermore, necessary information may be printed on the side on which the heat sensitive recording layer is provided or the opposite side.

According to the heat sensitive recording material of the present invention, multicolor recording can be carried out to obtain a vivid image portion. In this case, two or more normally colorless or light colored dye precursors which react with the electron accepting color developer upon heating to form different color hues are contained.

As layer construction for the multicolor recording, it is preferred for obtaining vivid image portions that two or more normally colorless or light colored dye precursors which react with the electron accepting color developer upon heating to form different color hues are contained in different heat sensitive recording layers and these heat sensitive recording layer which form different color hues are laminated. There are a method of providing the resin layer of the present invention between these heat sensitive recording layers, a method of containing the resin in a part or all of these laminated heat sensitive recording layers and a method of combination thereof. For example, the resin may be contained in a layer under the undermost heat sensitive recording layer. Alternatively, the resin may be contained in the undermost heat sensitive recording layer. The heat sensitive recording material comprising a plurality of the heat sensitive recording layers can be obtained in the same manner as the case of one heat sensitive recording layer, except that a plurality of the heat sensitive recording layers are provided.

The upper heat sensitive recording layers form a color by lower heat energy and the lower layers form color by the higher heat energy.

As the method for carrying out the multicolor recording, for example, in the case of the resin layer being provided between two heat sensitive recording layers which form different color hues upon heating, first, when a low heat energy is applied, an image portion of the first color is obtained in the heat sensitive recording layer provided on the resin layer. Next, when a higher heat energy is applied, an image portion of the second color is obtained in the heat sensitive recording layer provided under the resin layer. In this case, the image portion of the first color is erased by the resin layer. Thus, both the image portions of the first and second colors are clear in hue with no cloudiness and have a contrast. Similarly, in the case of three colors, when the image portion of the third color is obtained, the image portions of the first and second colors are erased, and the respective image portions have vivid hue with no cloudiness and have good contrast. There is no special upper limit in the number of color hues obtained by the heat sensitive recording materials of the present invention. Furthermore, if necessary, a fixed portion can be obtained.

In many cases, each of the layers of the heat sensitive recording materials mentioned above is advantageouly prepared by blending the components in the form of an aqueous dispersion, aqueous emulsion or aqueous solution and coating the dispersion, emulsion or solution. The method for coating is unlimited and the layers can be formed by conventional coating method. There may be used, for example, coating devices such as air knife coater, blade coater, bar coater and curtain coater and various printing devices of such types as lithographic printing, letterpress printing, intaglio printing, flexographic printing, gravure printing, screen printing and hot-melt printing. In addition to the usual drying step, each of the layers can be maintained by UV irradiation and electron beam irradiation. The layers can be coated or printed one by one or simultaneously by the above methods.

Furthermore, for coating of the layer containing resin and others, an organic solvent may be used as a medium for coating liquid in place of water. In this case, the resin in the coating liquid may be in the form of dispersion or solution. Moreover, when the resin and others are heat-meltable, they may be hot-melt coated without using the medium. The resin may be laminated in the form of a film. The method of using a solution in water or organic solvent is also effective as a means for impregnating the support with the resin.

Nonlimiting examples of preferred organic solvents as the coating media are aromatic hydrocarbons such as mesitylene, xylene and toluene; aliphatic hydrocarbons such as hexane, heptane, octane, decane and cyclohexane; siloxanes such as hexamethyldisiloxane; esters such as ethyl acetate, methyl acetate, butyl acetate and ethylene carbonate; ketones such as acetone, methyl ethyl ketone and methyl isopropyl ketone; ethers such as diethyl ether, tetrahydrofuran, diisopropyl ether, tetrahydropyran and dimethoxyethane; and alcohols such as methyl alcohol, ethyl alcohol, isopropyl alcohol, ethylene glycol and 2-ethoxyethyl alcohol. These may be used each alone or in combination of two or more.

Next, the recording method using the heat sensitive recording material of the present invention will be explained. The image portion is obtained by applying to the ground of the recording material a temperature or heat energy necessary for color formation. Furthermore, when an excess temperature or heat energy is applied to the ground or the image portion, a fixed portion is obtained. Examples of the means to obtain the image portion or the fixed portion are hot pen, thermal head, hot stamp, hot roll, hot air, infrared ray, high-frequency heating, laser beam and frictional heat. The means for obtaining the fixed portion and the image portion may be the same or different. Use of thermal head is preferred in view of its simplicity. Furthermore, formation of the image portion by application of low energy and formation of the fixed portion by application of high energy can be simultaneously carried out and this is convenient. No image portion can be obtained by subjecting the fixed portion to re-heating treatment.

The heat sensitive recording material of the present invention can be applied to various uses by optionally setting the steps or means to obtain the fixed portion and the image portion. Examples of the use will be explained below. When it is used for prevention of falsification of slips, the falsification can be prevented by forming a fixed portion around the image portion. There is a merit that the image portion and the fixed portion can be obtained simultaneously. For the prevention of falsification of a part of documents or slips, it is also possible to obtain the fixed portion by a means different from that for obtaining the image portion, for example, by a hot stamp. This is simpler than a method of printing a desensitized ink for the prevention of falsification of slips prepared by pressure-sensitive copying. Moreover, genuineness can be examined utilizing the facts that a fixed portion can also be obtained in the image portion and heat sensitive recording on the fixed portion cannot be carried out, and this can be utilized for bankbooks and papers for bills.

When the heat sensitive recording material is used for keeping secret or prevention of re-using of various documents and notes, the original image information can be erased by converting the image portion in the documents and the surroundings thereof to a fixed portion. The fixed portion can be optionally formed in the area of a part or the whole of the heat sensitive recording material. If necessary and convenient, the whole of the heat sensitive recording material may be heated to obtain the fixed portion. This has the merits that no noize is generated as compared with use of shredder, a large volume of documents can be disposed of at once, and waste heat sensitive recording materials can be reused as white papers or can be made to resource litters.

Further, a latent image of a letter comprising the fixed portion is formed on the heat sensitive recording material and this can be utilized for uses such as toys or tickets on a raffle which require latent images. If the whole area is recorded later to form images in the portion other than the fixed portion, the latent image becomes a negative type image. Since a negative image is obtained, this can be utilized for uses such as a display for ceremonial occasions or OHP. As a means for obtaining a negative image, the image portion and the fixed portion may be obtained simultaneously. Furthermore, the desired portion of the heat sensitive recording material is once subjected to solid printing to form an image, and a fixed portion corresponding to the pattern such as letter may be obtained in that image portion.

The heat sensitive recording material of the present invention by which multicolor recording can be carried out are used for various uses by optionally selecting the number and the kind of color hues. If necessary, a fixed portion can be provided. Examples of the use are ATM/CD, cash register, slips, notes, thickets, video output, television output, game machines, car navigator output, digital camera output, medical treatments (diagnosis of image), computer graphics output, toys, education by correspondence, raffle, drafting (CAD output), plotter, label, preparation of posters or banner strung, various displays in factories and factory site, postcards, advertizement such as show bills, various handy terminals, various cards, shop displays such as price tags and bar codes, word processor, facsimile, net work terminals for personal computer communication, and various printers for OHP and the like. The present invention is not limited to these uses. Moreover, the heat sensitive recording materials of the present invention can be used preferably for various recording methods such as photofixing type heat sensitive recording, melting type thermal transfer recording, sublimation type thermal transfer recording, electro-photographic recording, silver salt photographic recording and ink jet recording, and various printing methods and substitution for handwriting.

The following examples are intended to further illustrate the present invention. All parts and percentages are by weight. The unit for saponification value is mg KOH/g.

EXAMPLE 1

Preparation of Heat Sensitive Recording Material (A) Preparation of coating liquid for resin layer:

A dicyclopentadiene-vinyl acetate copolymer (saponification value: 142) was pre-ground and further ground with the following formulation by a paint conditioner to obtain a resin dispersion.

| | Part |
|---|---|
| Dicyclopentadiene-vinyl acetate copolymer | 120 |
| 10% Aqueous polyvinyl alcohol solution | 60 |
| Water | 420 |

Using the resulting resin dispersion, a coating liquid for resin layer with the following formulation was prepared.

| | Part |
|---|---|
| Resin dispersion | 700 |
| 10% Aqueous polyvinyl alcohol solution | 280 |
| Water | 20 |

(B) Preparation of coating liquid for heat sensitive recording layer:

600 parts of 3-di-n-butylamino-6-methyl-7-anilinofluoran as a dye precursor was ground together with 2400 parts of a 2.5% aqueous polyvinyl alcohol solution by a paint conditioner to obtain 3000 parts of a dye precursor dispersion. Then, 600 parts of 1,1-bis(4-hydroxyphenyl) cyclohexane was ground together with 2400 parts of a 2.5% aqueous polyvinyl alcohol solution by a paint conditioner to obtain 3000 parts of a color developer dispersion.

The resulting two dispersions were mixed and, then, the following components were added to the mixture with stirring, and these were well mixed to obtain a coating liquid for heat sensitive recording layer.

| | Part |
|---|---|
| 30% Aluminum hydroxide dispersion | 2000 |
| 10% Aqueous polyvinyl alcohol solution | 1800 |
| Water | 200 |

(C) Preparation of coating liquid for protective layer

The following components were well mixed to prepare a coating liquid for protective layer.

| | Part |
|---|---|
| 30% Aluminum hydroxide dispersion | 25 |
| 10% Aqueous polyvinyl alcohol solution | 150 |
| Water | 125 |

(D) Preparation of heat sensitive recording material

The coating liquid for resin layer prepared in the above (A) was coated on a base paper having a basis weight of 170 g/m$^2$ and dried and subjected to calendering. The solid coating amount of the resin layer was 6.0 g/m$^2$. Then, the coating liquid for heat sensitive recording layer prepared in the above (B) was coated on the resin layer and dried, and subjected to calendering. The solid coating amount of the heat sensitive recording layer was 2.3 g/m$^2$. Then, the coating liquid for protective layer prepared in the above (C) was coated on the heat sensitive recording layer and dried, and subjected to calendering so that the solid coating amount was 1.2 g/m$^2$, to obtain a heat sensitive recording material.

EXAMPLE 2

A heat sensitive recording material was obtained in the same manner as in Example 1, except that a dicyclopentadiene-vinyl acetate copolymer having a saponification value of 100 was used as the resin.

EXAMPLE 3

A heat sensitive recording material was obtained in the same manner as in Example 1, except that a dicyclopentadiene-vinyl acetate copolymer having a saponification value of 120 was used as the resin.

EXAMPLE 4

A heat sensitive recording material was obtained in the same manner as in Example 1, except that a dicyclopentadiene-vinyl acetate copolymer having a saponification value of 160 was used as the resin.

EXAMPLE 5

A heat sensitive recording material was obtained in the same manner as in Example 1, except that a dicyclopentadiene-vinyl acetate copolymer having a saponification value of 180 was used as the resin.

EXAMPLE 6

A heat sensitive recording material was obtained in the same manner as in Example 1, except that a dicyclopentadiene-vinyl acetate copolymer having a saponification value of 200 was used as the resin.

EXAMPLE 7

A heat sensitive recording material was obtained in the same manner as in Example 1, except that a dicyclopentadiene-vinyl acetate copolymer having a saponification value of 250 was used as the resin.

EXAMPLE 8

A heat sensitive recording material was obtained in the same manner as in Example 1, except that a dicyclopentadiene-vinyl acetate copolymer having a saponification value of 300 was used as the resin.

EXAMPLE 9

A heat sensitive recording material was obtained in the same manner as in Example 1, except that a dicyclopentadiene-vinyl acetate copolymer having a saponification value of 700 was used as the resin.

EXAMPLE 10

A heat sensitive recording material was obtained in the same manner as in Example 1, except that a dicyclopentadiene-vinyl acetate-styrene terpolymer having a saponification value of 140 was used as the resin.

EXAMPLE 11

A heat sensitive recording material was obtained in the same manner as in Example 1, except that a resin (saponification value of 100) prepared using rosin as a raw material and mainly composed of glyceryl abietate was used as the resin.

EXAMPLE 12

A heat sensitive recording material was obtained in the same manner as in Example 1, except that a cresol novolak type epoxy resin (epoxy equivalent: 200 g/l mol epoxy group) was used as the resin.

EXAMPLE 13

A heat sensitive recording material was obtained in the same manner as in Example 1, except that the solid coating amount of the resin layer was changed to 2.0 g/m$^2$.

EXAMPLE 14

A heat sensitive recording material was obtained in the same manner as in Example 1, except that the solid coating amount of the resin layer was changed to 4.0 g/m$^2$.

EXAMPLE 15

A heat sensitive recording material was obtained in the same manner as in Example 1, except that the solid coating amount of the resin layer was changed to 10.0 g/m$^2$.

EXAMPLE 16

A heat sensitive recording material was obtained in the same manner as in Example 1, except that the solid coating amount of the resin layer was changed to 15.0 g/m$^2$.

EXAMPLE 17

A heat sensitive recording material was obtained in the same manner as in Example 1, except that a woodfree paper having a basis weight of 100 g/m$^2$ was used as the support.

EXAMPLE 18

A heat sensitive recording material was obtained in the same manner as in Example 1, except that a woodfree paper having a basis weight of 50 g/m$^2$ was used as the support.

EXAMPLE 19

A heat sensitive recording material was obtained in the same manner as in Example 1, except that a foamed polyethylene terephthalate film (LUMILAR E62 #188 manufactured by Toray Industries, Inc.) having a thickness of 188$\mu$ was used as the support.

EXAMPLE 20

A heat sensitive recording material was obtained in the same manner as in Example 1, except that a white polyethylene terephthalate film (LUMILAR E22 #188 manufactured by Toray Industries, Inc.) having a thickness of 188$\mu$ was used as the support.

EXAMPLE 21

A heat sensitive recording material was obtained in the same manner as in Example 1, except that a 50% xylene solution of the resin used in Example 1 was used as the coating liquid for resin layer. The solid coating amount of the resin layer was also the same as in Example 1.

EXAMPLE 22

A heat sensitive recording material was obtained in the same manner as in Example 1, except that 2,2-bis(4-hydroxyphenyl)propane was used in place of 1,1-bis(4-hydroxyphenyl)cyclohexane as the color developer.

EXAMPLE 23

A heat sensitive recording material was obtained in the same manner as in Example 1, except that methyl 2,2-bis(4-hydroxyphenyl)acetate was used in place of 1,1-bis(4-hydroxyphenyl)cyclohexane as the color developer.

EXAMPLE 24

A heat sensitive recording material was obtained in the same manner as in Example 1, except that n-butyl 2,2-bis(4-hydroxyphenyl)acetate was used in place of 1,1-bis(4-hydroxyphenyl)cyclohexane as the color developer.

EXAMPLE 25

A heat sensitive recording material was obtained in the same manner as in Example 1, except that 3-(N-ethyl-N-tetrahydrofurylmethyl)amino-6-methyl-7-anilinofluoran was used in place of 3-di-n-butylamino-6-methyl-7-anilinofluoran as the dye precursor.

EXAMPLE 26

A heat sensitive recording material was obtained in the same manner as in Example 1, except that 3-(N-ethyl-N-3-ethoxypropyl)amino-6-methyl-7-anilinofluoran was used in place of 3-di-n-butylamino-6-methyl-7-anilinofluoran as the dye precursor.

EXAMPLE 27

A heat sensitive recording material was obtained in the same manner as in Example 1, except that 3-diethylamino-6-methyl-7-anilinofluoran was used in place of 3-di-n-butylamino-6-methyl-7-anilinofluoran as the dye precursor.

EXAMPLE 28

A heat sensitive recording material was obtained in the same manner as in Example 1, except that 3-(N-ethyl-N-p-tolyl)amino-6-methyl-7-anilinofluoran was used in place of 3-di-n-butylamino-6-methyl-7-anilinofluoran as the dye precursor.

EXAMPLE 29

A heat sensitive recording material was obtained in the same manner as in Example 1, except that 3-(1-ethyl-2-methylindol-3-yl)-3-(4-dimethylamino-2-ethoxyphenyl)-4-azaphthalide was used in place of 3-di-n-butylamino-6-methyl-7-anilinofluoran as the dye precursor.

EXAMPLE 30

A heat sensitive recording material was obtained in the same manner as in Example 1, except that 3,3-bis(p-dimethylaminophenyl)-6-dimethylaminophthalide was used in place of 3-di-n-butylamino-6-methyl-7-anilinofluoran as the dye precursor.

EXAMPLE 31

A heat sensitive recording material was obtained in the same manner as in Example 1, except that 3-diethylamino-6-methyl-7-chlorofluoran was used in place of 3-di-n-butylamino-6-methyl-7-anilinofluoran as the dye precursor.

EXAMPLE 32

A heat sensitive recording material was obtained in the same manner as in Example 1, except that 3,3-bis(4-diethylamino-2-ethoxyphenyl)-4-azaphthalide was used in place of 3-di-n-butylamino-6-methyl-7-anilinofluoran as the dye precursor.

Comparative Example 1

A heat sensitive recording material was obtained in the same manner as in Example 1, except that a polypropylene resin (saponification value: 0) was used as the resin. The solid coating amount of the resin layer was also the same as in Example 1.

Comparative Example 2

A heat sensitive recording material was obtained in the same manner as in Example 1, except that bis(m-cresyl) ether of ethylene glycol was used in place of the resin.

Comparative Example 3

A heat sensitive recording material was obtained in the same manner as in Example 1, except that a 30% methyl ethyl ketone solution of polyvinyl acetate (saponification value: 950) was used as the coating liquid for resin layer. The solid coating amount of the resin layer was also the same as in Example 1.

Recording Test by Thermal Head

The heat sensitive recording materials obtained in Examples 1–32 and Comparative Examples 1–3 were subjected to gradation printing by a heat sensitive facsimile printing tester TH-PMD manufactured by Ohkura Denki Co., Ltd. having a printing head LH4409 manufactured by TDK under the conditions of a pulse width in the range of 0.4–2.8 msec and a voltage of 20 volts. The applied energy per unit area (hereinafter referred to merely "applied energy") in this printing test was in the range of 20–140 mJ/mm$^2$. The density of the printed portion and others was measured by a densitometer Macbeth RD918. As filter, the optimum filter depending on the formed color hue was selected.

In the case of the heat sensitive recording materials of Examples 1–32 and Comparative Examples 1–2, image portions of high density of 1.20 or more in optical density were obtained by an applied energy in the range of 30–50 mJ/mm$^2$ while in the case of the heat sensitive recording material of Comparative Example 3, only the image portion of low density of 0.40 in optical density was obtained by the applied energy of the test condition. Furthermore, in the case of the heat sensitive recording materials of Examples 1–32 and Comparative Example 3, there was the conspicuous tendency that the density of the printed portion decreased with the higher applied energy. However, there was seen substantially no such tendency in the case of the heat sensitive recording materials of Comparative Examples 1 and 2.

In the heat sensitive recording materials of Examples 1–32 and Comparative Example 3, a fixed portion was obtained by printing the non-image portion by an applied energy in the range of 80–140 mJ/mm$^2$. The optical density of the fixed portion was less than 0.15, and the fixed portion could be easily discriminated from the image portion in the recording materials of Examples 1–32. However, in the recording material of Comparative Example 3, the image portion was low in density and contrast between the image portion and the fixed portion was inferior. The fixed portion could also be similarly obtained by again applying a high energy in the range of 80–140 mJ/mm$^2$ to the image portion of the recording material of Examples 1–32 and Comparative Example 3. On the other hand, in the recording materials of Comparative Examples 1–2, when the non-image portion was subjected to printing by an applied energy of 80–140 mJ/mm$^2$, the optical density exceeded 1.20 and a fixed portion of low density was not obtained.

Falsification Prevention Test

The fixed portion of the recording materials of Examples 1–32 obtained by the above printing test was again subjected to printing by an applied energy of 30–50 mJ/mm$^2$ by the heat sensitive facsimile printing tester, but no image portion could be obtained and it was difficult to confirm the trace of the reprinting by the naked eye. Thus, it was found that the fixed portion could be easily obtained and additional recording of the fixed portion by heating could be prevented. That is, it was confirmed that the heat sensitive recording materials of the present invention could be easily prevented from falsification. Storage stability test of image portion and other portions The highest density image portion among the image portions of the heat sensitive recording materials of Examples 1–32 and Comparative Examples 1–3 which were formed by the above printing test was left to stand in a thermostatic chamber kept at 60° C. for 24 hours, and, thereafter, the image density was measured. The optical density of the portion in the recording materials of Examples 1–32 and Comparative Examples 1–2 was 1.20 or higher and the density before the image storage stability test was substantially maintained. However, the optical density of the portion in the recording material of Comparative Example 3 was 0.10 and, thus, the recording material was inferior in the image storage stability. Moreover, the background portion and the fixed portion in the recording materials of Examples 1–32 were tested under the same conditions to find no fog. Furthermore, the fixed portion which was again subjected to printing in the recording materials of Examples 1–32 and which was obtained by the falsification prevention test was also tested under the same conditions as above and it was difficult to recognize the trace of the reprinting by the naked eyes after the test.

EXAMPLE 33

Preparation of Heat Sensitive Recording Material (A) Preparation of coating liquid for resin layer:

A carboxy-modified polyethylene terephthalate (ER 6620 manufactured by Japan Ester Co., Ltd.) which was a resin having a softening point of higher than 90° C. was preground and further finely ground with the following formulation by a paint conditioner to obtain a resin dispersion.

| | Part |
|---|---|
| ER6620 | 180 |
| 10% Aqueous polyvinyl alcohol solution | 90 |
| Water | 330 |

Using the resulting resin dispersion, a coating liquid for resin layer with the following formulation was prepared.

| | Part |
|---|---|
| Resin dispersion | 600 |
| 10% Aqueous polyvinyl alcohol solution | 360 |
| Water | 340 |

(B) Preparation of coating liquid for heat sensitive recording layer:

600 parts of 3-di-n-butylamino-6-methyl-7-anilinofluoran as a dye precursor was ground together with 2400 parts of a 2.5% aqueous polyvinyl alcohol solution by a paint conditioner to obtain 3000 parts of a dye precursor dispersion. Then, 600 parts of 1,1-bis(4-hydroxyphenyl) cyclohexane was ground together with 2400 parts of a 2.5% aqueous polyvinyl alcohol solution by a paint conditioner to obtain 3000 parts of a color developer dispersion.

The resulting two dispersions were mixed and, then, the following components were added to the mixture with stirring, and these were well mixed to obtain a coating liquid for heat sensitive recording layer.

| | Part |
|---|---|
| 30% Aluminum hydroxide dispersion | 2000 |
| 10% Aqueous polyvinyl alcohol solution | 1800 |
| Water | 200 |

(C) Preparation of coating liquid for protective layer

The following components were well mixed to prepare a coating liquid for protective layer.

| | Part |
|---|---|
| 30% Aluminum hydroxide dispersion | 25 |
| 10% Aqueous polyvinyl alcohol solution | 150 |
| Water | 125 |

(D) Preparation of heat sensitive recording material

The coating liquid for resin layer prepared in the above (A) was coated on a foamed polyethylene terephthalate film (LUMILAR E62 #188 manufactured by Toray Industries, Inc.) and dried and subjected to calendering. The solid coating amount of the resin layer was 6.0 g/m$^2$. Then, the coating liquid for heat sensitive recording layer prepared in the above (B) was coated on the resin layer and dried, and subjected to calendering. The solid coating amount of the heat sensitive recording layer was 2.3 g/m$^2$. Then, the coating liquid for protective layer prepared in the above (C) was coated on the heat sensitive recording layer and dried, and subjected to calendering so that the solid coating amount was 1.2 g/m$^2$, to obtain a heat sensitive recording material.

(E) Measurement of properties and others 100 parts of ER6620 as a resin and 200 parts of 1,1-bis (4-hydroxyphenyl)cyclohexane as a color developer were mixed and the mixture was heat molten and cooled by leaving to obtain a mixed melt. The mixed melt was left to stand at room temperature and, then, subjected to X-ray diffraction to find no peak which originated from the crystal of the color developer. That is, crystallinity of the color developer was 0%. Moreover, ER6620 had no ability to cause color formation of the dye precursor. Furthermore, ER6620 used did not reach the melting point (liquefying temperature) at 90° C. Further, the solubility of ER6620 in water was less than 1%.

EXAMPLE 34

A heat sensitive recording material was obtained in the same manner as in Example 33, except that an ester group-containing dicyclopentadiene alicyclic hydrocarbon resin (QUINTON 1525L manufactured by Nippon Zeon Co., Ltd.) was used in place of ER6620.

100 parts of QUINTON 1525L as resin and 200 parts of 1,1-bis(4-hydroxyphenyl)cyclohexane as color developer were mixed and the mixture was heat molten and cooled by leaving to obtain a mixed melt. The mixed melt was left to stand at room temperature and, then, subjected to X-ray diffraction analysis to find no peak originating from the crystal of the color developer. That is, crystallinity of the color developer was 0%. Moreover, QUINTON 1525L had no ability to cause color formation of the dye precursor. Furthermore, QUINTON 1525L used did not reach the melting point (liquefying temperature) at 90° C. Further, the solubility of QUINTON 1525L in water was less than 1%.

EXAMPLE 35

A heat sensitive recording material was obtained in the same manner as in Example 33, except that a terpene phenol resin (TAMANOL 803L manufactured by Arakawa Chemical Co., Ltd.) was used in place of ER6620.

100 parts of TAMANOL 803L as resin and 200 parts of 1,1-bis(4-hydroxyphenyl)cyclohexane as color developer were mixed and the mixture was heat molten and cooled by leaving it to obtain a mixed melt. The mixed melt was left to stand at room temperature and, then, subjected to X-ray diffraction analysis to find no peak originating from the crystal of the color developer. That is, crystallinity of the color developer was 0%. Moreover, TAMANOL 803L had no ability to bring about color formation of the dye precursor. Furthermore, TAMANOL 803L used did not reach the melting point (liquefying temperature) at 90° C. Further, the solubility of TAMANOL 803L in water was less than 1%.

EXAMPLE 36

A heat sensitive recording material was obtained in the same manner as in Example 33, except that a rosin-modified maleic acid resin (MALKEED No.1 manufactured by Arakawa Chemical Co., Ltd.) was used in place of ER6620.

100 parts of MALKEED No.1 as resin and 100 parts of 1,1-bis(4-hydroxyphenyl)cyclohexane as color developer were mixed and the mixture was heat molten and cooled by leaving it to obtain a mixed melt. The mixed melt was left to stand at room temperature and, then, subjected to X-ray diffraction analysis to find no peak originating from the crystal of the color developer. That is, crystallinity of the color developer was 0%. Moreover, MALKEED No.1 had no ability to bring about color formation of the dye precursor. Furthermore, MALKEED used did not reach the melting point (liquefying temperature) at 90° C. Further, the solubility of MALKEED No.1 in water was less than 1%.

EXAMPLE 37

A heat sensitive recording material was obtained in the same manner as in Example 33, except that a cyclohexanone type ketone resin (HALON 80 manufactured by Honshu Chemical Co., Ltd.) was used in place of ER6620.

100 parts of HALON as resin and 200 parts of 1,1-bis(4-hydroxyphenyl)cyclohexane as color developer were mixed and the mixture was heat molten and left to cool to obtain a mixed melt. The mixed melt was left to stand at room temperature and, then, subjected to X-ray diffraction analysis to find no peak originating from the crystal of the color developer. That is, crystallinity of the color developer was 0%. Moreover, HALON 80 had no ability to cause color formation of the dye precursor. Furthermore, HALON 80 used did not reach the melting point (liquefying temperature) at 70° C. Further, the solubility of HALON 80 in water was less than 1%.

EXAMPLE 38

A heat sensitive recording material was obtained in the same manner as in Example 33, except that the solid coating amount of the resin layer was changed to 2.0 g/m$^2$.

EXAMPLE 39

A heat sensitive recording material was obtained in the same manner as in Example 33, except that the solid coating amount of the resin layer was changed to 4.0 g/m$^2$.

EXAMPLE 40

A heat sensitive recording material was obtained in the same manner as in Example 33, except that the solid coating amount of the resin layer was changed to 10.0 g/m$^2$.

EXAMPLE 41

A heat sensitive recording material was obtained in the same manner as in Example 33, except that the solid coating amount of the resin layer was changed to 15.0 g/m$^2$.

EXAMPLE 42

A heat sensitive recording material was obtained in the same manner as in Example 33, except that a woodfree paper having a basis weight of 170 g/m$^2$ was used as the support.

EXAMPLE 43

A heat sensitive recording material was obtained in the same manner as in Example 33, except that a 50% xylene solution of an ester group-containing dicyclopentadiene alicyclic hydrocarbon resin (QUINTON 1525L manufactured by Nippon Zeon Co., Ltd.) was used as the coating liquid for resin layer. The solid coating amount of the resin layer was also the same as in Example 33.

EXAMPLE 44

A heat sensitive recording material was obtained in the same manner as in Example 33, except that 2,2-bis(4-hydroxyphenyl)propane was used in place of 1,1-bis(4-hydroxyphenyl)cyclohexane as a color developer. 100 parts of the resin and 200 parts of the color developer were mixed and the mixture was heat molten and left to cool to obtain a mixed melt. The mixed melt was subjected to X-ray diffraction analysis in the same manner as in Example 33. No crystal of the color developer was found from the X-ray diffraction. That is, crystallinity of the color developer was 0%.

EXAMPLE 45

A heat sensitive recording material was obtained in the same manner as in Example 33, except that methyl 2,2-bis(4-hydroxyphenyl)acetate was used in place of 1,1-bis(4-hydroxyphenyl)cyclohexane as a color developer. 100 parts of the resin and 200 parts of the color developer were mixed and the mixture was heat molten and left to cool to obtain a mixed melt. The mixed melt was subjected to X-ray diffraction analysis in the same manner as in Example 33. No crystal of the color developer was found from the X-ray diffraction. That is, crystallinity of the color developer was 0%.

EXAMPLE 46

A heat sensitive recording material was obtained in the same manner as in Example 33, except that n-butyl 2,2-bis(4-hydroxyphenyl)acetate was used in place of 1,1-bis(4-hydroxyphenyl)cyclohexane as a color developer. 100 parts of the resin and 200 parts of the color developer were mixed and the mixture was heat molten and left to cool to obtain a mixed melt. The mixed melt was subjected to X-ray diffraction analysis in the same manner as in Example 33. As a result, no crystal of the color developer was found from the X-ray diffraction. That is, crystallinity of the color developer was 0%.

EXAMPLE 47

A heat sensitive recording material was obtained in the same manner as in Example 33, except that benzyl 4-hydroxybenzoate was used in place of 1,1-bis(4-hydroxyphenyl)cyclohexane as a color developer. 100 parts of the resin and 200 parts of the color developer were mixed and the mixture was heat molten and left to cool to obtain a mixed melt. The mixed melt was subjected to X-ray diffraction analysis in the same manner as in Example 33. As a result, no crystal of the color developer was found from the X-ray diffraction. That is, crystallinity of the color developer was 0%.

EXAMPLE 48

A heat sensitive recording material was obtained in the same manner as in Example 33, except that 3-diethylamino-6-methyl-7-anilinofluoran was used in place of 3-di-butylamino-6-methyl-7-anilinofluoran as a dye precursor.

EXAMPLE 49

A heat sensitive recording material was obtained in the same manner as in Example 33, except that 3-(N-ethyl-N-p-tolyl)amino-6-methyl-7-anilinofluoran was used in place of 3-di-butylamino-6-methyl-7-anilinofluoran as a dye precursor.

EXAMPLE 50

A heat sensitive recording material was obtained in the same manner as in Example 33, except that 3-(1-ethyl-2-methylindol-3-yl)-3-(4-dimethyl-2-ethoxyphenyl)-4-azaphthalide was used in place of 3-di-butylamino-6-methyl-7-anilinofluoran as a dye precursor.

EXAMPLE 51

A heat sensitive recording material was obtained in the same manner as in Example 33, except that 3,3-bis(p-dimethylaminophenyl)-6-dimethylaminophthalide was used in place of 3-di-butylamino-6-methyl-7-anilinofluoran as a dye precursor.

EXAMPLE 52

A heat sensitive recording material was obtained in the same manner as in Example 33, except that 3-diethylamino-6-methyl-7-chlorofluoran was used in place of 3-di-butylamino-6-methyl-7-anilinofluoran as a dye precursor.

EXAMPLE 53

A heat sensitive recording material was obtained in the same manner as in Example 33, except that 3,3-bis(4-diethylamino-2-ethoxyphenyl)-4-azaphthalide was used in place of 3-di-butylamino-6-methyl-7-anilinofluoran as a dye precursor.

Comparative Example 4

A heat sensitive recording material was obtained in the same manner as in Example 33, except that a xylene solution of a dicyclopentadiene alicyclic hydrocarbon resin (QUINTON A100 manufactured by Nippon Zeon Co., Ltd.) was used as the coating liquid for resin layer and a woodfree paper having a basis weight of 170 g/m$^2$ was used in place of the foamed polyethylene terephthalate film as the support. The solid coating amount of the resin layer was also the same as in Example 33.

100 parts of the resin QUINTON A100 and 50 parts of 1,1-bis(4-hydroxyphenyl)cyclohexane as the color developer were mixed and the mixture was heat molten and left to cool to obtain a mixed melt. The mixed melt was left to stand at room temperature and, then, subjected to X-ray diffraction analysis. As a result, a peak originating from crystal of the color developer was seen. A mere powder mixture of QUINTON A100 and 1,1-bis(4-hydroxyphenyl)cyclohexane as the color developer which had the same compositional ratio as above was prepared and the peak originating from the color developer was also observed. This peak was compared with the peak originating from the crystal of the color developer in the mixed melt to find that the crystallinity of the color developer was higher than 50%. The QUINTON A100 did not reach the melting point (liquefying temperature) at 90° C. The solubility of QUINTON A100 in water was lower than 1%.

Comparative Example 5

A heat sensitive recording material was obtained in the same manner as in Example 33, except that p-benzylbiphenyl was used in place of ER6620 and a woodfree paper having a basis weight of 170 g/m$^2$ was used in place of the foamed polyethylene terephthalate film as the support.

100 parts of p-benzylphenyl and 50 parts of 1,1-bis(4-hydroxyphenyl)cyclohexane as the color developer were mixed and the mixture was heat molten and left to cool to obtain a mixed melt. The mixed melt was left to stand at room temperature and, then, subjected to X-ray diffraction analysis. As a result, a peak originating from crystal of the color developer was seen. A mere powder mixture of p-benzylbiphenyl and 1,1-bis(4-hydroxyphenyl) cyclohexane as the color developer which had the same compositional ratio as above was prepared and peak originating from the color developer was also observed. This peak was compared with the peak originating from the crystal of the color developer in the mixed melt to find that the crystallinity of the color developer was higher than 50%. The p-benzylbiphenyl had a melting point of 87° C. The solubility of p-benzylbiphenyl in water was lower than 1%.

Comparative Example 6

A heat sensitive recording material was obtained in the same manner as in Example 33, except that dicyclohexyl phthalate was used in place of ER6620. The melting point of dicyclohexyl phthalate was 65° C. 100 parts of dicyclohexyl phthalate and 50 parts of 1,1-bis(4-hydroxyphenyl) cyclohexane as the color developer were mixed and the mixture was heat molten and left to cool to obtain a mixed melt. The mixed melt was left to stand at room temperature and, then, subjected to X-ray diffraction analysis. As a result, no peak originating from crystal of the color developer was found. That is, crystallinity of the color developer was 0%. Further, dicyclohexyl phthalate had no ability to cause color formation of the dye precursor. The solubility of dicyclohexyl phthalate in water was lower than 1%.

Recording Test by Thermal Head

The heat sensitive recording materials obtained in Examples 33–53 and Comparative Examples 4–6 were subjected to gradation printing by a heat sensitive facsimile printing tester TH-PMD manufactured by Ohkura Denki Co., Ltd. having a printing head KJT-256-8MGF1 manufactured by Kyocela Co., Ltd. under the conditions of a pulse width in the range of 0.3–2.0 msec and a voltage of 26 volts. The applied energy in this printing test was in the range of 15–100 mJ/mm$^2$. The density of the printed portion was measured by a densitometer Macbeth RD918. As for the filter, the optimum filter depending on the formed color hue was selected.

In the case of the heat sensitive recording materials of Examples 33–53 and Comparative Examples 4–5, image portions of high density of 1.10–1.20 in optical density were obtained by an applied energy in the range of 30–35 mJ/mm$^2$ while in the case of the heat sensitive recording material of Comparative Example 6, the density of the image portion was 0.45 by the applied energy of the test condition. Furthermore, in the case of the heat sensitive recording materials of Examples 33–53 and Comparative Example 6, there was the conspicuous tendency that the density of the printed portion decreased with the higher applied energy. However, such tendency was slightly seen or no such tendency was seen in the case of the heat sensitive recording materials of Comparative Examples 4–5.

In the heat sensitive recording materials of Examples 33–53, a fixed portion was obtained by printing the non-image portion by an applied energy in the range of 80–100 mJ/mm$^2$. The optical density of the fixed portion was less than 0.15, and the fixed portion could be easily discriminated from the image portion. The fixed portion could also be similarly obtained by again applying the energy in the range of 80–100 mJ/mm$^2$ to the image portion of the recording material of Examples 33–53. On the other hand, in the recording materials of Comparative Examples 4–5, when the non-image portion was subjected to printing by an applied energy of 80–100 mJ/mm$^2$, the optical density of the printed portion exceeded 0.90 and no fixed portion could be obtained. The optical density of the image portion in the recording material of Comparative Example 6 was low and the contrast between the fixed portion and the image portion was inferior.

Falsification Prevention Test

The fixed portion of the recording materials of Examples 33–53 obtained by the above printing test was again subjected to printing by an applied energy of 30–35 mJ/mm$^2$ by the heat sensitive facsimile printing tester, but no image portion could be obtained and it was difficult to recognize the trace of the reprinting by the naked eye. Thus, it was found that the fixed portion could be easily obtained and additional recording of the fixed portion by heating could be prevented. That is, it was confirmed that the heat sensitive recording materials of the present invention could be easily prevented from falsification.

Storage Stability Test of Image Portion and Other Portions

The highest density image portion among the image portions in the heat sensitive recording materials of Examples 33–53 and Comparative Examples 4–6 which were formed by the printing test was left to stand in a thermostatic chamber kept at 60° C. for 24 hours, and, thereafter, the image density was measured. The optical density of the portion in the recording materials of Examples 33–53 and Comparative Examples 4–5 was 1.10 or higher and the density before the test was substantially maintained. However, the density of the image portion in the recording material of Comparative Example 6 was 0.10 and, thus, even the discrimination from the background portion was difficult. Moreover, the background portion and the fixed portion in the recording materials of Examples 33–53 were tested under the same conditions to find no fog. Furthermore, the fixed portion which was again subjected to printing in the recording materials of Examples 33–53 and which was obtained by the falsification prevention test was also tested under the same conditions as above and it was difficult to recognize the trace of the reprinting by the naked eyes after the test.

EXAMPLE 54

Preparation of Heat Sensitive Recording Material on Which Multicolor Recording Can be Performed (example of two colors)

(A) Preparation of coating liquid for heat sensitive recording layer of the second color:

600 parts of 3-di-n-butylamino-6-methyl-7-chlorofluoran as a dye precursor was ground together with 2400 parts of a 2.5% aqueous polyvinyl alcohol solution by a paint conditioner to obtain 3000 parts of a dye precursor dispersion. Then, 600 parts of bis(4-hydroxyphenyl)sulfone was ground together with 2400 parts of a 2.5% aqueous polyvinyl alcohol solution by a paint conditioner to obtain 3000 parts of a color developer dispersion.

The resulting two dispersions were mixed and, then, the following components were added to the mixture with stirring, and these were well mixed to prepare a coating liquid for heat sensitive recording layer of the second color.

| | Part |
|---|---|
| 30% Aluminum hydroxide dispersion | 2000 |
| 10% Aqueous polyvinyl alcohol solution | 1800 |
| Water | 200 |

(B) Preparation of coating liquid for resin layer:

A resin comprising dicyclopentadiene-vinyl acetate copolymer (saponification value: 142) was pre-ground and further finely ground at the following formulation by a paint conditioner to obtain a resin dispersion.

| | Part |
|---|---|
| Resin | 140 |
| 10% Aqueous polyvinyl alcohol solution | 70 |
| Water | 490 |

Using the resulting resin dispersion, a coating liquid for resin layer with the following formulation was prepared.

| | Part |
|---|---|
| Resin dispersion | 700 |
| 10% Aqueous polyvinyl alcohol solution | 280 |
| Water | 20 |

(C) Preparation of coating liquid for heat sensitive recording layer of the first color:

600 parts of 3-di-n-butylamino-6-methyl-7-anilinofluoran as a dye precursor was ground together with 2400 parts of a 2.5% aqueous polyvinyl alcohol solution by a paint conditioner to obtain 3000 parts of a dye precursor dispersion. Then, 600 parts of 1,1-bis(4-hydroxyphenyl) cyclohexane was ground together with 2400 parts of a 2.5% aqueous polyvinyl alcohol solution by a paint conditioner to obtain 3000 parts of a color developer dispersion.

The resulting two dispersions were mixed and, then, the following components were added to the mixture with stirring, and these were well mixed to prepare a coating liquid for heat sensitive recording layer of the first color.

| | Part |
|---|---|
| 30% Aluminum hydroxide dispersion | 2000 |
| 10% Aqueous polyvinyl alcohol solution | 1800 |
| Water | 200 |

(D) Preparation of coating liquid for protective layer

The following components were well mixed to prepare a coating liquid for protective layer.

| | Part |
|---|---|
| 30% Aluminum hydroxide dispersion | 25 |
| 10% Aqueous polyvinyl alcohol solution | 150 |
| Water | 125 |

(E) Preparation of heat sensitive recording material

The coating liquid for heat sensitive recording layer of the second color prepared in the above (A) was coated on a base paper having a basis weight of 170 g/m$^2$ and dried and subjected to calendering. The solid coating amount of the heat sensitive recording layer of the second color was 2.5 g/m$^2$. The coating liquid for resin layer prepared in the above (B) was coated on the heat sensitive recording layer of the second color and dried and subjected to calendering. The solid coating amount of the resin layer was 6.0 g/m$^2$. Then, the coating liquid for heat sensitive recording layer of the first color prepared in the above (C) was coated on the resin layer and dried, and subjected to calendering. The solid coating amount of the heat sensitive recording layer of the first color was 2.3 g/m$^2$. Then, the coating liquid for protective layer prepared in the above (D) was coated on the heat sensitive recording layer of the first color and dried, and subjected to calendering so that the solid coating amount was 1.2 g/m$^2$, thereby to prepare a heat sensitive recording material.

EXAMPLE 55

A heat sensitive recording material was obtained in the same manner as in Example 54, except that a dicyclopentadiene-vinyl acetate copolymer having a saponification value of 100 was used as the resin.

EXAMPLE 56

A heat sensitive recording material was obtained in the same manner as in Example 54, except that a dicyclopentadiene-vinyl acetate copolymer having a saponification value of 120 was used as the resin.

EXAMPLE 57

A heat sensitive recording material was obtained in the same manner as in Example 54, except that a dicyclopentadiene-vinyl acetate copolymer having a saponification value of 160 was used as the resin.

EXAMPLE 58

A heat sensitive recording material was obtained in the same manner as in Example 54, except that a dicyclopentadiene-vinyl acetate copolymer having a saponification value of 180 was used as the resin.

EXAMPLE 59

A heat sensitive recording material was obtained in the same manner as in Example 54, except that a dicyclopentadiene-vinyl acetate copolymer having a saponification value of 200 was used as the resin.

EXAMPLE 60

A heat sensitive recording material was obtained in the same manner as in Example 54, except that a dicyclopentadiene-vinyl acetate copolymer having a saponification value of 250 was used as the resin.

EXAMPLE 61

A heat sensitive recording material was obtained in the same manner as in Example 54, except that a dicyclopentadiene-vinyl acetate copolymer having a saponification value of 300 was used as the resin.

EXAMPLE 62

A heat sensitive recording material was obtained in the same manner as in Example 54, except that a dicyclopentadiene-vinyl acetate copolymer having a saponification value of 700 was used as the resin.

EXAMPLE 63

A heat sensitive recording material was obtained in the same manner as in Example 54, except that a dicyclopentadiene-vinyl acetate-styrene terpolymer having a saponification value of 140 was used as the resin.

EXAMPLE 64

A heat sensitive recording material was obtained in the same manner as in Example 54, except that a resin (saponification value: 100) prepared using pine resin as a raw material and mainly composed of glyceryl abietate was used as the resin.

EXAMPLE 65

A heat sensitive recording material was obtained in the same manner as in Example 54, except that a cresol novolak type epoxy resin (EOCN103S manufactured by Nippon Kayaku Co., Ltd.) was used as the resin.

EXAMPLE 66

A heat sensitive recording material was obtained in the same manner as in Example 54, except that the solid coating amount of the resin layer was changed to 2.0 g/m$^2$.

EXAMPLE 67

A heat sensitive recording material was obtained in the same manner as in Example 54, except that the solid coating amount of the resin layer was changed to 4.0 g/m$^2$.

EXAMPLE 68

A heat sensitive recording material was obtained in the same manner as in Example 54, except that the solid coating amount of the resin layer was changed to 10.0 g/m$^2$.

EXAMPLE 69

A heat sensitive recording material was obtained in the same manner as in Example 54, except that the solid coating amount of the resin layer was changed to 15.0 g/m$^2$.

EXAMPLE 70

A heat sensitive recording material was obtained in the same manner as in Example 54, except that a woodfree paper having a basis weight of 100 g/m$^2$ was used as the support.

EXAMPLE 71

A heat sensitive recording material was obtained in the same manner as in Example 54, except that a woodfree paper having a basis weight of 50 g/m$^2$ was used as the support.

EXAMPLE 72

A heat sensitive recording material was obtained in the same manner as in Example 54, except that a foamed polyethylene terephthalate film (LUMILAR E62 #188 manufactured by Toray Industries, Inc.) having a thickness of 188$\mu$ was used as the support.

EXAMPLE 73

A heat sensitive recording material was obtained in the same manner as in Example 54, except that a white polyethylene terephthalate film (LUMILAR E22 #188 manufactured by Toray Industries, Inc.) having a thickness of 188$\mu$ was used as the support.

EXAMPLE 74

A heat sensitive recording material was obtained in the same manner as in Example 54, except that a 50% xylene solution of the resin used in Example 1 was used as the coating liquid for resin layer. The solid coating amount of the resin layer was also the same as in Example 54.

EXAMPLE 75

A heat sensitive recording material was obtained in the same manner as in Example 54, except that 2,2-bis(4-hydroxyphenyl)propane was used in place of 1,1-bis(4-hydroxyphenyl)cyclohexane as the color developer.

EXAMPLE 76

A heat sensitive recording material was obtained in the same manner as in Example 54, except that methyl 2,2-bis(4-hydroxyphenyl)acetate was used in place of 1,1-bis(4-hydroxyphenyl)cyclohexane as the color developer.

EXAMPLE 77

A heat sensitive recording material was obtained in the same manner as in Example 54, except that n-butyl 2,2-bis(4-hydroxyphenyl)acetate was used in place of 1,1-bis(4-hydroxyphenyl)cyclohexane as the color developer.

EXAMPLE 78

A heat sensitive recording material was obtained in the same manner as in Example 54, except that 3-(N-ethyl-N-tetrahydrofurylmethyl)amino-6-methyl-7-anilinofluoran was used in place of 3-di-n-butylamino-6-methyl-7-anilinofluoran as the dye precursor.

EXAMPLE 79

A heat sensitive recording material was obtained in the same manner as in Example 54, except that 3-(N-ethyl-N-3-ethoxypropyl)amino-6-methyl-7-anilinofluoran was used in place of 3-di-n-butylamino-6-methyl-7-anilinofluoran as the dye precursor.

EXAMPLE 80

A heat sensitive recording material was obtained in the same manner as in Example 54, except that 3-diethylamino-6-methyl-7-anilinofluoran was used in place of 3-di-n-butylamino-6-methyl-7-anilinofluoran as the dye precursor.

EXAMPLE 81

A heat sensitive recording material was obtained in the same manner as in Example 54, except that 3-(N-ethyl-N-p-tolyl)amino-6-methyl-7-anilinofluoran was used. in place of 3-di-n-butylamino-6-methyl-7-anilinofluoran as the dye precursor.

EXAMPLE 82

A heat sensitive recording material was obtained in the same manner as in Example 54, except that 3-(1-ethyl-2-methylindol-3-yl)-3-(4-dimethylamino-2-ethoxyphenyl)-4-azaphthalide was used in place of 3-di-n-butylamino-6-methyl-7-anilinofluoran as the dye precursor.

EXAMPLE 83

A heat sensitive recording material was obtained in the same manner as in Example 54, except that 3,3-bis(p-dimethylaminophenyl)-6-dimethylaminophthalide was used in place of 3-di-n-butylamino-6-methyl-7-anilinofluoran as the dye precursor.

EXAMPLE 84

A heat sensitive recording material was obtained in the same manner as in Example 54, except that zinc 4-hexadecanoylaminosalicylate was used in place of bis(4-hydroxyphenyl)sulfone as the color developer.

EXAMPLE 85

A heat sensitive recording material was obtained in the same manner as in Example 54, except that zinc 4-decanoylaminosalicylate was used in place of bis(4-hydroxyphenyl)sulfone as the color developer.

Comparative Example 7

A heat sensitive recording material was obtained in the same manner as in Example 54, except that a polypropylene resin (saponification value: 0) was used as the resin. The solid coating amount of the resin layer was also the same as in Example 54.

Comparative Example 8

A heat sensitive recording material was obtained in the same manner as in Example 54, except that bis(m-cresyl) ether of ethylene glycol was used in place of the resin.

Comparative Example 9

A heat sensitive recording material was obtained in the same manner as in Example 54, except that a 30% methyl ethyl ketone solution of polyvinyl acetate (saponification value: 950) was used as the coating liquid for resin layer. The solid coating amount of the resin layer was also the same as in Example 54.

Recording Test by Thermal Head

The heat sensitive recording materials obtained in Examples 54–85 and Comparative Examples 7–9 were subjected to gradation printing by a heat sensitive facsimile printing tester TH-PMD manufactured by Ohkura Denki Co., Ltd. having a printing head LH4409 manufactured by TDK under the conditions of a pulse width in the range of 0.4–2.8 msec and a voltage of 20 volts. The applied energy in this printing test was in the range of 20–140 mJ/mm$^2$. The density of the printed portion was measured by a densitometer Macbeth RD918. As for filter, the optimum filter depending on the formed color hue was selected.

In the heat sensitive recording materials of Examples 54–85 and Comparative Examples 7–9, image portions of the first color having a high density of 1.20 or more in optical density were obtained by an applied energy in the range of 30–50 mJ/mm$^2$ while in the heat sensitive recording material of Comparative Example 9, the image portion of the first color of low density of 0.40 in optical density was obtained by the applied energy of the test condition. Furthermore, in the heat sensitive recording materials of Examples 54–85 and Comparative Example 9, there was obtained an image portion of the second color of 1.20 or higher in optical density by the applied energy of 80–140 mJ/mm$^2$, the contrast between the images of the first and second colors was good. However, in the recording materials of Comparative Examples 7 and 8, the image portion of the second color was a mixed color with the first color and the contrast was inferior.

Storage Stability Test of Image Portion and Other Portions

The highest density image portions of the first color and the second color among the image portions in the heat sensitive recording materials of Examples 54–85 and Comparative Examples 7–9 which were formed by the printing test was left to stand in a thermostatic chamber kept at 60° C. for 24 hours, and, thereafter, the image density was measured. The optical density of the portions in the recording materials of Examples 54–85 and Comparative Examples 7–8 was 1.20 or higher and the density before the test was substantially maintained. However, the optical density of the image portion of the first color in the recording material of Comparative Example 9 was 0.10 and, thus, the recording material was inferior in the image storage stability. Moreover, the background portion in the recording materials of Examples 54–85 were tested under the same conditions to find no fog.

EXAMPLE 86

Preparation of Heat Sensitive Recording Material on Which Multicolor Recording Can be Performed (example of three colors)

(A) Preparation of coating liquid for heat sensitive recording layer of the third color:

600 parts of 3-di-n-butylamino-7-chlorofluoran as a dye precursor was ground together with 2400 parts of a 2.5% aqueous polyvinyl alcohol solution by a paint conditioner to obtain 3000 parts of a dye precursor dispersion. Then, 600 parts of zinc 4-hexadecanoylaminosalicylate was ground together with 2400 parts of a 2.5% aqueous polyvinyl alcohol solution by a paint conditioner to obtain 3000 parts of a color developer dispersion.

The resulting two dispersions were mixed and, then, the following components were added to the mixture with stirring, and these were well mixed to prepare a coating liquid for heat sensitive recording layer of the third color.

| | Part |
|---|---|
| 30% Aluminum hydroxide dispersion | 2000 |
| 10% Aqueous polyvinyl alcohol solution | 1800 |
| Water | 200 |

(B) Preparation of coating liquid for resin layer:

A resin comprising dicyclopentadiene-vinyl acetate copolymer (saponification value: 142) was pre-ground and further finely ground at the following formulation by a paint conditioner to obtain a resin dispersion.

| | Part |
|---|---|
| Resin | 120 |
| 10% Aqueous polyvinyl alcohol solution | 60 |
| Water | 420 |

Using the resulting resin dispersion, a coating liquid for resin layer with the following formulation was prepared.

| | Part |
|---|---|
| Resin dispersion | 700 |
| 10% Aqueous polyvinyl alcohol solution | 280 |
| Water | 20 |

(C) Preparation of coating liquid for heat sensitive recording layer of the second color:

600 parts of 3,3-bis(p-dimethylaminophenyl)-6-dimethylaminophthalide as a dye precursor was ground together with 2400 parts of a 2.5% aqueous polyvinyl alcohol solution by a paint conditioner to obtain 3000 parts of a dye precursor dispersion. Then, 900 parts of 1,1-bis(4-hydroxyphenyl)cyclohexane was ground together with 3600 parts of a 2.5% aqueous polyvinyl alcohol solution by a paint conditioner to obtain 4500 parts of a color developer dispersion.

The resulting two dispersions were mixed and, then, the following components were added to the mixture with stirring, and these were well mixed to prepare a coating liquid for heat sensitive recording layer of the second color.

| | Part |
|---|---|
| 30% Barium sulfide dispersion | 2000 |
| 10% Aqueous polyvinyl alcohol solution | 1800 |
| Water | 200 |

(D) Preparation of coating liquid for heat sensitive recording layer of the first color:

600 parts of 3-di-n-butylamino-6-methyl-7-anilinofluoran as a dye precursor was ground together with 2400 parts of a 2.5% aqueous polyvinyl alcohol solution by a paint conditioner to obtain 3000 parts of a dye precursor dispersion. Then, 600 parts of 1,1-bis(4-hydroxyphenyl) cyclohexane was ground together with 2400 parts of a 2.5% aqueous polyvinyl alcohol solution by a paint conditioner to obtain 3000 parts of a color developer dispersion.

These two dispersions were mixed and, then, the following components were added to the mixture with stirring, and these were well mixed to prepare a coating liquid for heat sensitive recording layer of the first color.

| | Part |
|---|---|
| 30% Aluminum hydroxide dispersion | 2000 |
| 10% Aqueous polyvinyl alcohol solution | 1800 |
| Water | 200 |

(E) Preparation of coating liquid for protective layer

The following components were well mixed to prepare a coating liquid for protective layer.

| | Part |
|---|---|
| 30% Aluminum hydroxide dispersion | 25 |
| 10% Aqueous polyvinyl alcohol solution | 150 |
| Water | 125 |

(F) Preparation of heat sensitive recording material

The coating liquid for heat sensitive recording layer of the third color prepared in the above (A) was coated on a foamed polyethylene terephthalate film having a thickness of 188$\mu$ and dried and subjected to calendering. The solid coating amount of the heat sensitive recording layer of the third color was 2.5 g/m$^2$. The coating liquid for resin layer prepared in the above (B) was coated on the heat sensitive recording layer of the third color and dried and subjected to calendering. The solid coating amount of the resin layer was 8.0 g/m$^2$ (this resin layer being referred to as "second resin layer" hereinafter). Then, the coating liquid for heat sensitive recording layer of the second color prepared in the above (C) was coated on the resin layer and dried, and subjected to calendering. The solid coating amount of the heat sensitive recording layer of the second color was 2.5 g/m$^2$. The coating liquid for resin layer prepared in the above (B) was coated on the heat sensitive recording layer of the second color and dried, and subjected to calendering. The solid coating amount of the resin layer was 6.0 g/m$^2$ (this resin layer being referred to as "first resin layer" hereinafter). Then, the coating liquid for heat sensitive recording layer of the first color prepared in the above (D) was coated on the first resin layer and dried, and subjected to calendering. The solid coating amount of the heat sensitive recording layer of the first color was 2.3 g/m$^2$. Then, the coating liquid for protective layer prepared in the above (E) was coated on the heat sensitive recording layer of the first color and dried, and subjected to calendering so that the solid coating amount was 1.3 g/m$^2$, thereby to prepare a heat sensitive recording material. Thus, the layer construction comprised a support and, provided thereon in succession, the heat sensitive recording layer of the third color, the second resin layer, the heat sensitive recording layer of the second color, the first resin layer, the heat sensitive recording layer of the first color, and the protective layer.

EXAMPLE 87

A heat sensitive recording material was obtained in the same manner as in Example 86, except that the dye precursors used in the respective heat sensitive recording layers were changed to 3,3-bis(4-diethylamino-2-ethoxyphenyl)-4-azaphthalide in the heat sensitive recording layer of the third color, 3-(1-ethyl-2-methylindol-3-yl)-3-(4-dimethylamino-2-ethoxyphenyl)-4-azaphthalide in the heat sensitive recording layer of the second color, and 3-diethylamino-6-methyl-7-anilinofluoran in the heat sensitive recording layer of the first color.

EXAMPLE 88

A heat sensitive recording material was obtained in the same manner as in Example 86, except that the dye precursors used in the respective heat sensitive recording layers were changed to 3,6-di-methoxyfluoran in the heat sensitive recording layer of the third color, 3,3-bis(4-diethylamino-2-ethoxyphenyl)-4-azaphthalide in the heat sensitive recording layer of the second color, and 3-(1-ethyl-2-methylindol-3-yl)-3-(4-dimethylamino-2-ethoxyphenyl)-4-azaphthalide in the heat sensitive recording layer of the first color.

Comparative Example 10

A heat sensitive recording material was obtained in the same manner as in Example 86, except that a polypropylene resin (saponification value: 0) was used as the resin. The solid coating amounts of the second resin layer and the first resin layer were also the same as in Example 86.

Recording Test by Thermal Head

The heat sensitive recording materials obtained in Examples 86–88 and Comparative Example 10 were subjected to gradation printing by a heat sensitive facsimile printing tester TH-PMD manufactured by Ohkura Denki Co., Ltd. having a printing head LH4409 manufactured by TDK under the conditions of a pulse width in the range of 0.4–4.0 msec and a voltage of 20 volts. The applied energy in this printing test was in the range of 20–200 mJ/mm$^2$. The density of the printed portion and others was measured by a densitometer Macbeth RD918. As the filter, the optimum one depending on the formed color hue was selected.

In the heat sensitive recording materials of Examples 86–88 and Comparative Example 10, vivid image portions of the first color having a high optical density of 1.20 or more were obtained by an applied energy of 40 mJ/mm$^2$. Furthermore, in the heat sensitive recording materials of Examples 86–88, vivid image portions of the second color having a high optical density of 1.20 or more were obtained by an applied energy of 80 mJ/mm$^2$. The contrast between the image portion of the first color and that of the second color was good. However, in the heat sensitive recording material of Comparative Example 10, the image portion of the second color obtained by an applied energy of 80 mJ/mm$^2$ comprised a dim mixed color with the first color and the contrast was inferior. Moreover, in the heat sensitive recording materials of Examples 86–88, vivid image portions of the third color having a high optical density of 1.20 or more were obtained by an applied energy of 140 mJ/mm$^2$.

The contrast between the image portion of the third color and the image portion of the first color and that of the second color was good. However, in the heat sensitive recording material of Comparative Example 10, the image portion of the third color obtained by an applied energy of 140 mJ/mm$^2$ comprised a dim mixed color with the first color and the second color, and the contrast was inferior.

Storage Stability Test of Image Portion and Other Portions

The highest density image portions of the first, second and third colors among the image portions in the heat sensitive recording materials of Examples 86–88 and Comparative Example 10 which were formed by the printing test were left to stand in a thermostatic chamber kept at 60° C. for 24 hours, and, thereafter, the image density was measured. The optical density of the portions in the recording materials of Examples 86–88 and Comparative Example 10 was 1.20 or higher and the density before the test was substantially maintained. In the recording materials of Examples 86–88, change in color hue was not seen after the test and the vividness was also maintained. Moreover, the background portion in the recording materials of Examples 86–88 were tested under the same conditions to find no fog.

EXAMPLE 89

(Preparation of coating liquid for resin layer)

An expoxy resin having a softening point of 70° C. or higher (SUMI-EPOXY ESA-011 manufactured by Sumitomo Chemical Co., Ltd.) was pre-ground by a small grinder (SAMPLE MILL SK-M manufactured by Kyoritsu Riko Co., Ltd.) and further finely ground at the following formulation by a paint conditioner to obtain a ground resin dispersion.

| | Part |
|---|---|
| Epoxy resin | 30 |
| 10% Aqueous polyvinyl alcohol solution | 15 |
| Water | 55 |

Using the resulting ground resin dispersion, a coating liquid for resin layer with the following formulation was prepared.

| | Part |
|---|---|
| Ground resin dispersion | 77 |
| 10% Aqueous polyvinyl alcohol solution | 23 |
| Water | 50 |

(Preparation of coating liquid for heat sensitive recording layer)

3-Diethylamino-7-chlorofluoran as a dye precursor was finely ground with the following formulation by a paint conditioner to obtain a dye precursor dispersion.

| | Part |
|---|---|
| 3-Diethylamino-7-chlorofluoran | 30 |
| 10% Aqueous polyvinyl alcohol solution | 15 |
| Water | 55 |

1,1-Bis(4-hydroxyphenyl)cyclohexane as a color developer was finely ground with the following formulation by a paint conditioner to obtain a color developer dispersion.

| | Part |
|---|---|
| 1,1-Bis(4-hydroxyphenyl)cyclohexane | 30 |
| 10% Aqueous polyvinyl alcohol solution | 15 |
| Water | 55 |

Using the resultant dye precursor dispersion and color developer dispersion, a coating liquid for heat sensitive recording layer of the following formulation was prepared.

| | Part |
|---|---|
| Dye precursor dispersion | 38 |
| Color developer dispersion | 38 |
| 10% Aqueous polyvinyl alcohol solution | 23 |
| Water | 51 |

(Preparation of heat sensitive recording material)

The coating liquid for resin layer, the coating liquid for heat sensitive recording layer and a coating liquid for protective layer (5% aqueous polyvinyl alcohol solution) were coated in succession on a foamed PET film (LUMILAR E62 #188 manufactured by Toray Industries, Inc.), dried and calendered at dry coating amounts of 15 g/m$^2$, 1.5 g/m$^2$ and 0.8 g/m$^2$, respectively, to obtain a heat sensitive recording material.

EXAMPLE 90

A heat sensitive recording material was obtained in the same manner as in Example 89, except that a xylene resin (NIKANOL HP-100 manufactured by Mitsubishi Gas Chemical Co., Ltd.) was used in place of the epoxy resin.

EXAMPLE 91

A heat sensitive recording material was obtained in the same manner as in Example 89, except that an aromatic polyester resin (ER-6550 manufactured by Japan Ester Co., Ltd.) was used in place of the epoxy resin.

EXAMPLE 92

A heat sensitive recording material was obtained in the same manner as in Example 89, except that a terpene phenol resin (TAMANOL 803L manufactured by Arakawa Chemical Co., Ltd.) was used in place of the epoxy resin.

EXAMPLE 93

A heat sensitive recording material was obtained in the same manner as in Example 89, except that a rosin-modified phenolic resin (OR-7000 manufactured by Seiko Chemical Co., Ltd.) was used in place of the epoxy resin.

EXAMPLE 94

A heat sensitive recording material was obtained in the same manner as in Example 89, except that a phenoxy resin (PKHC manufactured by Tomoe Kogyo Co., Ltd.) was used in place of the epoxy resin.

EXAMPLE 95

A heat sensitive recording material was obtained in the same manner as in Example 89, except that a styrene resin (HIMER ST95 manufactured by Sanyo Kasei Kogyo Co., Ltd.) was used in place of the epoxy resin.

EXAMPLE 96

A heat sensitive recording material was obtained in the same manner as in Example 89, except that a coating liquid for resin layer prepared in the following manner using a polyether sulfone resin (4100P manufactured by Sumitomo Chemical Co., Ltd.) was used in place of the coating liquid for resin layer of the epoxy resin shown in the explanation of preparation of the coating liquid for resin layer in Example 89.

(Preparation of coating liquid for resin layer)

A 9% solution of the polyether sulfone resin in ethyl acetate was emulsion dispersed in a 6% aqueous polyvinyl alcohol solution (PVA217 manufactured by Kuraray Co., Ltd.) with the following formulation by a homogenizer (ACE HOMOGENIZER AM-TYPE manufactured by Nippon Seiki Seisakusho Co., Ltd.) and the dispersion was stirred in a water bath of 80° C. to obtain a coating liquid for resin layer.

| | Part |
|---|---|
| 9% Solution of polyether sulfone in ethyl acetate | 44 |
| 6% Aqueous polyvinyl alcohol solution | 50 |

EXAMPLE 97

A heat sensitive recording material was obtained in the same manner as in Example 89, except that a maleic acid resin (MALKEED No.1 having an acid value of 25 mg KOH/g manufactured by Arakawa Chemical Co., Ltd.) was used in place of the epoxy resin.

EXAMPLE 98

A heat sensitive recording material was obtained in the same manner as in Example 89, except that a coating liquid for resin layer prepared in the following manner using a long chain olefin glycol resin (AOG-X68 having an acid value of 0.5–1 mg KOH/g manufactured by Daicel Ltd.) was used in place of the coating liquid for resin layer of the epoxy resin shown in the explanation of preparation of the coating liquid for resin layer in Example 89.

(Preparation of coating liquid for resin layer)

The long chain olefin glycol resin was dissolved in ethyl acetate with the following formulation to obtain a coating liquid for resin layer.

| | Part |
|---|---|
| The long chain olefin glycol resin | 5 |
| Ethyl acetate | 95 |

EXAMPLE 99

A heat sensitive recording material was obtained in the same manner as in Example 89, except that a coating liquid for resin layer prepared in the following manner using a methacrylic resin (SUMIPEX LG6 manufactured by Sumitomo Chemical Co., Ltd.) was used in place of the coating liquid for resin layer of the epoxy resin shown in the explanation of preparation of the coating liquid for resin layer in Example 89.

(Preparation of coating liquid for resin layer)

A 9% solution of the methacrylic resin in ethyl acetate was emulsion dispersed in a 6% aqueous polyvinyl alcohol solution (PVA217 manufactured by Kuraray Co., Ltd.) with the following formulation by a homogenizer (ACE HOMOGENIZER AM-TYPE manufactured by Nippon Seiki Seisakusho Co., Ltd.) and the dispersion was stirred in a water bath of 80° C. to obtain a coating liquid for resin layer.

| | Part |
|---|---|
| 9% Solution of the methacrylic resin in ethyl acetate | 44 |
| 6% Aqueous polyvinyl alcohol solution | 50 |

EXAMPLE 100

A heat sensitive recording material was obtained in the same manner as in Example 89, except that a hydroxyl group-containing dicyclopentadiene alicyclic hydrocarbon resin (QUINTON 1700 manufactured by Nippon Zeon Co., Ltd.) was used in place of the epoxy resin.

EXAMPLE 101

A heat sensitive recording material was obtained in the same manner as in Example 89, except that a ketone resin (HALON 110H having an acid value of 0.2–1 mg KOH/g manufactured by Honshu Chemical Co., Ltd.) was used in place of the epoxy resin.

EXAMPLE 102

(Preparation of coating liquid for resin-containing heat sensitive recording layer)

Using the ground resin dispersion, the dye precursor dispersion and the color developer dispersion prepared in Example 89, a coating liquid for resin-containing heat sensitive recording layer of the following formulation was prepared.

| | Part |
|---|---|
| Ground resin dispersion | 38 |
| Dye precursor dispersion | 38 |
| Color developer dispersion | 38 |
| 10% Aqueous polyvinyl alcohol solution | 23 |
| Water | 13 |

(Preparation of heat sensitive recording material)

The coating liquid for resin-containing heat sensitive recording layer was coated on a foamed PET film (LUMILAR E62 #188 manufactured by Toray Industries, Inc.) and calendered at dry coating amount of 3 g/m$^2$ to obtain a heat sensitive recording material.

EXAMPLE 103

A heat sensitive recording material was obtained in the same manner as in Example 89, except that a maleic acid resin (M-2015 having an acid value of 155 mg KOH/g manufactured by Seiko Chemical Co., Ltd.) was used in place of the epoxy resin.

Comparative Example 11

A heat sensitive recording material was obtained in the same manner as in Example 89, except that a coating liquid for resin layer prepared in the following manner using polyvinyl alcohol was used in place of the coating liquid for resin layer of the epoxy resin shown in the explanation of the preparation of the coating liquid for resin layer in Example 89.

(Preparation of coating liquid for resin layer)

Polyvinyl alcohol was dissolved in water in a water bath of 80° C. with the following formulation to prepare a coating liquid for resin layer.

| | Part |
|---|---|
| Polyvinyl alcohol | 10 |
| Water | 90 |

Comparative Example 12

A heat sensitive recording material was obtained in the same manner as in Example 89, except that a maleic acid resin (MALKEED No.34 having an acid value of 290–320 mg KOH/g manufactured by Arakawa Chemical Co., Ltd.) was used in place of the epoxy resin.

The seventeen heat sensitive recording materials obtained in Examples 89–103 and Comparative Examples 11 and 12 were subjected to simultaneous formation of the image portion (recording) and the fixed portion (fixing) by a thermal head. That is, recording and fixing were carried out simultansously in one printing step by applying an energy of 30 mJ/mm$^2$ and an energy of 90 mJ/mm$^2$, respecitively, using a heat sensitive sheet printing tester (TH-PMD manufactured by Ohkura Denki Co., Ltd. which gave an applied energy of 10–114 mJ/mm$^2$ and was provided with a thermal head KJT-256-8MGF1 manufactured by Kyocera Co., Ltd.). The image portion and the fixed portion were evaluated by measuring optical density using Macbeth densitometer RD-918. As for the heat sensitive recording materials of Examples 89–103 and Comparative Example 12, the fixed portion was again subjected to printing by an applied energy of 30 mJ/mm$^2$ and the optical density of this reprinted portion was measured. No fixed portion of low optical density could be obtained in the recording material of Comparative Example 12.

Results of the evaluation are shown in Tables 1 and 2. In the recording materials of Examples 89–101 and 103, the image portion had a high optical density of at least 0.9 and the fixed portion had a low optical density of at most 0.2. In the recording material of Example 102 having a resin-containing heat sensitive recording layer, the image portion had an optical density of 0.7 and the fixed portion had a low optical density of lower than 0.2. Thus, in the recording materials of Examples 89–103, the image portion and the fixed portion could be easily discriminated from each other. On the other hand, in the recording material of Comparative Example 11, the image portion had a high optical density of 1.0, but the fixed portion remained high in optical density, namely, 0.7, and the image portion and the fixed portion were difficult to discriminate from each other. As to the reprinted portion of the fixed portion, no re-formation of color was seen and the optical density of the fixed portion did not change to retain the fixed state in the recording materials of Examples 89–103. In the recording material of Comparative Example 11, the fixed portion retained the high optical density and remained in the color formed state, and no conspicuous change of the density was seen.

The results of evaluation on the difference in acid value of the resin are shown in Table 3. In the recording materials of Examples 99 and 100 where resins having no acid value were used and those of Examples 97, 98, 101 and 103 where resins having an acid value of 155 mg KOH/g or less were used, the image portions all had an optical density of at least 0.9, the fixed portion had a low optical density of 0.2 or less as mentioned above while in the recording material of Comparative Example 12 where a resin having an acid value of 290–320 mg KOH/g was used, the optical density of the image portion reached 1.0 while that of the fixed portion remained at high value of about 0.6.

TABLE 1

Results of evaluation depending on resin

| Example | Resin | Density of image portion | Density of fixed portion | Density of reprinted portion |
|---|---|---|---|---|
| 89 | Epoxy resin | 0.92 | 0.13 | 0.11 |
| 90 | Xylene resin | 1.10 | 0.20 | 0.19 |
| 91 | Aromatic polyester resin | 0.99 | 0.13 | 0.11 |
| 92 | Terpene phenol resin | 1.10 | 0.14 | 0.13 |
| 93 | Rosin-modified phenol resin | 1.09 | 0.16 | 0.15 |
| 94 | Phenoxy resin | 0.90 | 0.20 | 0.19 |
| 95 | Styrene resin | 0.91 | 0.18 | 0.16 |
| Comparative Example 11 | Polyvinyl alcohol | 1.10 | 0.70 | 0.70 |

TABLE 2

Results of evaluation depending on resins

| Example | Resin | Density of image portion | Density of Color erased portion | Density of reprinted portion |
|---|---|---|---|---|
| 96 | Polyether sulfone | 0.90 | 0.20 | 0.19 |
| 97 | Maleic acid resin | 0.95 | 0.14 | 0.13 |
| 98 | Longchain olefin glycol | 0.90 | 0.20 | 0.19 |
| 99 | Methacrylic resin | 0.91 | 0.13 | 0.11 |
| 100 | Dicyclopentadiene resin | 0.90 | 0.13 | 0.11 |
| 101 | Ketone resin | 0.91 | 0.10 | 0.19 |
| 102 | Aromatic polyester resin | 0.70 | 0.13 | 0.11 |
| 103 | Maleic acid resin | 1.09 | 0.16 | 0.15 |
| Comparative Example 11 | Polyvinyl alcohol | 1.10 | 0.70 | 0.70 |

TABLE 3

Results of evaluation depending on resins having different acid values

| Example | Resin | Acid value of resin mg KOH/g | Density of image portion | Density of fixed portion |
|---|---|---|---|---|
| 97 | Maleic acid resin | 25 | 0.95 | 0.14 |
| 98 | Longchain olefin glycol | 0.5–1 | 0.90 | 0.20 |
| 99 | Methacrylic resin | No | 0.91 | 0.13 |
| 100 | Dicyclopentadiene resin | No | 0.90 | 0.13 |
| 101 | Ketone resin | 0.2–1 | 0.91 | 0.10 |
| 103 | Maleic acid resin | 155 | 1.09 | 0.16 |
| Comparative Example 12 | Maleic acid resin | 290–320 | 1.00 | 0.60 |

A heat sensitive recording material which can be simply prevented from falsification is obtained by containing a resin in the recording material according to the present invention. The heat sensitive recording material of the present invention is high in density of image portion, excellent in contrast between fixed portion and image portion and, further, excellent in image storage stability. Moreover, recording and fixing can be carried out simultaneously by a thermal head. Furthermore, the heat sensitive recording material capable of carrying out multicolor recording of the present invention is excellent in density of image portion, in contrast between the image portions and, further, in image storage stability.

What is claimed is:

1. A heat sensitive recording material comprising a support and, provided thereon, a heat sensitive recording layer containing a colorless or light colored dye precursor and an electron accepting color developer which reacts with the dye precursor upon heating to cause color formation of the dye precursor, where the heat sensitive recording material contains at least one water-insoluble resin selected from the group consisting of an aromatic resin, a resin having a low or no acid value, and a resin having a carbonyl group and an alicyclic unit.

2. A heat sensitive recording material according to claim 1, wherein the water-insoluble resin is a resin having a carbonyl group and an alicyclic unit which is a copolymer of a compound having a carbonyl group and dicyclopentadiene.

3. A heat sensitive recording material according to claim 1, wherein the water-insoluble resin is a resin having a carbonyl group and an alicyclic unit which is a resin having an ester group and an alicyclic unit.

4. A heat sensitive recording material according to claim 3, wherein the resin having an ester group and an alicyclic unit is a copolymer of dicyclopentadiene and vinyl acetate.

5. A heat sensitive recording material according to claim 3, wherein the resin having an ester group and an alicyclic unit has a saponification value of 50–700 mg KOH/g.

6. A heat sensitive recording material according to claim 1, wherein the water-insoluble resin is an aromatic resin selected from the group consisting of epoxy resin, xylene resin, polyester resin, terpene phenol resin, rosin-modified phenolic resin, phenoxy resin, styrene resin, polyethylene terephthalate, carboxy-modified polyethylene terephthalate, polybutylene terephthalate, allyl resin, methyl methacrylate-styrene copolymer, methyl methacrylate-butadiene-styrene copolymer, oxybenzoylpolyester resin, aromatic petroleum resin, styrene-acrylonitrile copolymer, polyphenylene oxide resin, polyphenylene sulfide resin, polyether ether ketone resin, and polyether sulfone resin.

7. A heat sensitive recording material according to claim 6, wherein the aromatic resin is an epoxy resin having a glycidyl group and an aromatic ring unit.

8. A heat sensitive recording material according to claim 1, wherein the water-insoluble resin is the resin having a low acid value or no acid value selected from the group consisting of maleic acid resin, long chain olefin glycol, polymethyl methacrylate, acrylic ester resin, hydroxyl group-containing dicyclopentadiene alicyclic hydrocarbon resin, furan resin, bismaleimide-triazine resin, polycarbonate resin, polyarylate resin, polyacetal resin, unsaturated polyester resin, cumarone resin, polyimide resin, rosin-modified polyimide resin, poly(amide-imide) resin, polyurethane resin, polyvinyl-acetal resin, and ketone resin.

9. A heat sensitive recording material according to claim 8, wherein the ketone resin is cyclohexanone ketone resin.

10. A heat sensitive recording material according to claim 1, which contains at least two colorless or light colored dye precursors which react with the electron accepting color developer upon heating to form different color hues.

11. A heat sensitive recording material according to claim 1, wherein a plurality of heat sensitive recording layers differing in formed color hue from each other are provided.

12. A heat sensitive recording material according to claim 1, wherein said recording material contains separate particulate dispersions of said dye precursor and said resin.

13. A heat sensitive recording material comprising a support and, provided thereon, a colorless or light colored dye precursor, an electron accepting color developer which reacts with the dye precursor upon heating to cause color formation of the dye precursor and a resin having a softening point of 70° C. or higher, where the relation between the color developer and the resin is such that substantially no crystallized color developer is contained in a mixed melt obtained by mixing 100 parts by weight of the resin and 50–200 parts by weight of the color developer, heating and melting the mixture and, then, leaving the melt to cool.

14. A heat sensitive recording material according to claim 13, wherein the relation between the color developer and the resin is such that substantially no crystallized color developer is contained in a mixed melt obtained by mixing 100 parts by weight of the resin and 100–200 parts by weight of the color developer, heating and melting the mixture and, then, leaving the melt to cool.

15. A heat sensitive recording material according to claim 13, which contains at least two colorless or light colored dye precursors which react with the electron accepting color developer upon heating to form different color hues.

16. A heat sensitive recording material according to claim 13, wherein a plurality of heat sensitive recording layers differing in formed color hue from each other are provided.

17. A heat sensitive recording material according to claim 13, wherein said recording material contains separate particulate dispersions of said dye precursor and said resin.

* * * * *